US011406862B2

(12) United States Patent
Downing

(10) Patent No.: US 11,406,862 B2
(45) Date of Patent: Aug. 9, 2022

(54) SYSTEMS FOR SUPPORTING DUMBBELL AND BARBELL

(71) Applicant: Downing Family, LLC, Cordova, TN (US)

(72) Inventor: Philip Downing, Cordova, TN (US)

(73) Assignee: Downing Family, LLC, Cordova, TN (US)

( * ) Notice: Subject to any disclaimer, the term of this patent is extended or adjusted under 35 U.S.C. 154(b) by 30 days.

(21) Appl. No.: 16/790,466

(22) Filed: Feb. 13, 2020

(65) Prior Publication Data

US 2020/0261759 A1 Aug. 20, 2020

Related U.S. Application Data

(60) Provisional application No. 62/805,701, filed on Feb. 14, 2019.

(51) Int. Cl.
*A63B 21/078* (2006.01)
*A63B 21/072* (2006.01)
*A63B 71/00* (2006.01)

(52) U.S. Cl.
CPC ..... *A63B 21/0783* (2015.10); *A63B 21/078* (2013.01); *A63B 71/0036* (2013.01);
(Continued)

(58) Field of Classification Search
CPC ..... A63B 21/0615; A63B 21/078; A63B 21/0783; A63B 21/0724; A63B 21/0726; A63B 21/4047; A63B 2225/09; A63B 2225/093; A63B 71/0036; A63B 21/06; A63B 21/0601; A63B 21/0602; A63B 21/0608; A63B 21/0609; A63B 21/0616; A63B 21/0617; A63B 21/0618;
(Continued)

(56) References Cited

U.S. PATENT DOCUMENTS 3,552,748 A * 1/1971 Thomas ..... A63B 5/02 482/16
4,602,785 A * 7/1986 Rockwell ..... A63B 21/078 482/104
(Continued)

FOREIGN PATENT DOCUMENTS

DE 202010002842 U1 6/2010
EP 2939718 A1 11/2015

*Primary Examiner* — Nyca T Nguyen
*Assistant Examiner* — Zachary T Moore
(74) *Attorney, Agent, or Firm* — C. Brandon Browning; Maynard, Cooper & Gale, PC

(57) ABSTRACT

The present disclosure generally pertains to barbell and dumbbell support systems that allow for a user to perform exercises without requiring movement of the body of the user from the proximity of weight support assemblies when weights are in use. Weight support systems include extendable arm assemblies for the holding and positioning of barbells or dumbbells in a location conducive to performing exercises. Extendable arm assemblies automatically retract when a user removes the barbell or dumbbells from the assemblies, allowing the user to perform the intended exercise without moving away from the system. The retracted position of the extendable arm assemblies allows the user to replace the weights without the assistance of others at the conclusion of the exercise.

18 Claims, 25 Drawing Sheets

(52) U.S. Cl.
CPC ..... *A63B 21/0724* (2013.01); *A63B 21/0726* (2013.01); *A63B 2225/09* (2013.01)

(58) Field of Classification Search
CPC ..... A63B 21/062; A63B 21/0622; A63B 21/0624; A63B 21/072; A63B 21/0722; A63B 21/0728; A63B 21/075; A63B 21/08; A63B 21/22; A63B 21/4023; A63B 21/4029
USPC ..... 482/102
See application file for complete search history.

(56) References Cited

U.S. PATENT DOCUMENTS 5,151,072 A * 9/1992 Cone ..... A63B 21/078 482/104
5,281,193 A * 1/1994 Colbo, Jr. ..... A63B 21/078 482/142
5,472,397 A * 12/1995 Ammoscato ..... A63B 21/078 482/104
5,509,876 A * 4/1996 Reyes ..... A63B 21/078 482/104
5,954,619 A * 9/1999 Petrone ..... A63B 71/0036 482/104
6,149,556 A * 11/2000 Jordan ..... A63B 71/0036 482/106
6,447,433 B1 * 9/2002 Reyes ..... A63B 21/078 482/104
9,248,335 B2 * 2/2016 Reyes ..... A63B 21/078
9,597,539 B2 * 3/2017 Grider ..... A63B 21/00047
10,226,660 B2 * 3/2019 Wilkins ..... A63B 21/078
2007/0082795 A1 4/2007 Murray et al.
2009/0305851 A1 12/2009 Sukup
2013/0296143 A1 * 11/2013 Staten ..... A63B 21/0618 482/98
2014/0121073 A1 * 5/2014 Hardy ..... A63B 21/078 482/104
2014/0128229 A1 * 5/2014 York ..... A63B 21/078 482/104
2016/0101310 A1 4/2016 Staten et al.
2016/0213966 A1 * 7/2016 Chou ..... A63B 71/0036

* cited by examiner

SYSTEMS FOR SUPPORTING DUMBBELL AND BARBELL

RELATED APPLICATION

This application claims priority to U.S. Provisional Application No. 62/805,701, filed on Feb. 14, 2019, and titled "Systems for Supporting Dumbbell and Barbell," the entire contents of which are incorporated herein by reference.

TECHNICAL FIELD

The present invention is directed to support systems for the automatic retraction of dumbbell and barbell arm assemblies when a user performs an exercise using the barbell or dumbbells.

BACKGROUND OF INVENTION

Strength training systems are generally used to build strength and improve the endurance of a user. The activities typically associated with strength training include the use of resistance, often in the form of weights, to cause the muscles of a user to contract, increasing the strength of the muscles and the function of associated tendons, ligaments, and joints.

Exercises may include those with free weights, such as barbells and dumbbells, where a user controls the motion or location of these weights over a period of time or for a number of sets and repetitions. Different exercises are often undertaken to strengthen various muscle groups. While performing exercises with free weights, a user may undertake movements that are unconstrained by support equipment and thus a user often desires to perform such movements in an environment clear of equipment. In typical strength training systems with free weights, a user removes the weight or weights from a weight support structure by himself or with the assistance of another person and then must reposition the weights or the user's body in order to undertake the intended exercise. This process for barbells then is reversed when the user wishes to store the weight or weights in the weight support structure. This process for dumbbells typically begins by picking the dumbbells up from the floor and then returning the dumbbells to the floor following use.

The present invention allows a user to perform exercises with free weights without having to reposition or move the user's body from the weight support structure. At an accessible distance from the weight support system, the user may access dumbbells or a barbell, place them in the cradles and extend the extendable arm assemblies. The extendable arm assemblies are moved to the extension position from the retracted position to deliver the dumbbells or barbell. When the dumbbells or barbell are unloaded from the extended arm assemblies, the extendable arm assemblies automatically retract to steer clear the line of action of exercise. Therefore, the system enables the user to perform the exercise without having to move away from the system or seek the help of others to grab and lift the dumbbell or barbell weights. The retraction of the extendable arm assemblies is sufficiently close to the user, such that the user can replace the dumbbells or barbell back onto the cradle without the help of others.

SUMMARY OF INVENTION

The present invention is directed to an apparatus for supporting a weight used during exercises, comprising a base configured for being movably coupled to and extending horizontally from a vertically extending support frame, an arm assembly including a first arm having an upper end and a lower end, the lower end being pivotally coupled to and extending vertically from the base, and a cradle coupled to the upper end of the first arm, the cradle being configured for supporting the weight. The arm assembly is configured for selectively pivoting the cradle between a first position when the weight is supported by the cradle and a second position when the weight is removed from the cradle.

In some instances, the first position includes the cradle being at a first distance from the support frame and the second position includes the cradle being at a second distance from the support frame, the first distance being longer than the second distance. The arm assembly in some instances includes a second arm pivotally coupled to and between the base and the cradle, and further includes a strut assembly coupled to and between the first arm and the second arm, the strut assembly being configured to move the cradle from the first position to the second position when the weight is removed from the cradle. In some instances, the cradle includes a lower cradle frame having a pair of opposed support plates, each support plate having an upturned free end. The apparatus further includes a vertically arranged sleeve to which the base is coupled, the sleeve being configured to slidably engage the support frame. In some instances, this further includes a first hinge arm pivotally coupled to the sleeve, a second hinge arm pivotally coupled at one end thereof to the first arm and hingedly coupled to the first hinge arm at a second end thereof, and a spring assembly coupled to and between the base and the second end of the second hinge arm. In some instances, the apparatus further includes a roller arm having a first end portion pivotally coupled to the upper end of the first arm and a second end portion supporting a wheel arranged to roll against the sleeve. In some instances, the weight is selected from the group consisting of a barbell and a dumbbell.

In one aspect of the invention, there is provided an apparatus for supporting a weight used during exercises comprising a base operatively coupled to and extending horizontally from a support frame, an arm assembly extending vertically from the base, and a cradle supported by the arm assembly and configured for holding the weight. The arm assembly is configured for first maintaining the cradle in a first position when the weight is located on the cradle, next pivoting the cradle from the first position to a second position when the weight is removed from the cradle, and then pivoting the cradle from the second position to the first position when the weight is placed on the cradle, the first position including the cradle being at a first distance from the support frame and the second position including the cradle being at a second distance from the support frame, the first distance being longer than the second distance.

In some instances, the arm assembly includes a first arm and a second arm, each of the first arm and the second arm being pivotally coupled to the base. The apparatus may further include a strut assembly coupled to and between the first arm and the second arm, the strut assembly being configured for forcing the cradle to pivot from the first position to the second position. In some instances, the apparatus further includes a vertically arranged connection plate to which the base is coupled, the connection plate being configured for selectively attaching to the support frame. In some instances, the apparatus further includes a first hinge arm pivotally coupled to the connection plate, a second hinge arm pivotally coupled at one end thereof to the arm assembly and hingedly coupled to the first hinge arm at a second end thereof, and a spring assembly coupled to and between the base and the second end of the second hinge arm. The apparatus may further include a roller arm having a first end portion pivotally coupled to the arm assembly and a second end portion supporting a rotatable member, the support frame being arranged between the rotatable member and the arm assembly.

In yet another aspect of the invention, there is provided an apparatus for supporting a weight used during exercises comprising a frame arm extending vertically, a base operatively coupled to and extending horizontally from the frame arm, a cradle for supporting the weight, a pivot arm extending vertically to and between the base and the cradle, the pivot arm being pivotally coupled to the base, a first cradle position, the first cradle position including the cradle being at a first distance from the frame arm, a second cradle position, the second cradle position including the cradle being at a second distance from the frame arm, the first distance being longer than the second distance, and a first force exerted on the pivot arm sufficient to cause the cradle to pivot from the first cradle position to the second cradle position when the weight is not supported by the cradle.

In some instances, the cradle is pivotally coupled to the pivot arm and the first force is exerted on the pivot arm by a strut. In other instances, the first force is exerted on the pivot arm by a spring. In yet other instances, the first force is exerted on the pivot arm by a downwardly-curved arm coupled to and between the pivot arm and a rotatable member wherein the frame arm is located between the pivot arm and the rotatable member.

A further understanding of the nature and advantages of the present invention will be realized by reference to the remaining portions of the specification and the drawings.

BRIEF DESCRIPTION OF DRAWINGS

The present disclosure same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 2A is the system in an extension position of the extendable arm assemblies, while FIG. 2B is a retracted position of the extendable arm assemblies.

FIG. 4A depicts a mounting element, FIG. 4B depicts a holder and resting plate, and FIG. 4C depicts handles, brackets, and a strut used in the extendable arm assemblies.

FIG. 5A shows the lower cradle frame, FIG. 5B shows the upper cradle frame, and FIG. 5C shows the assembled cradles with both upper and lower frames connected.

FIG. 7A is the system in an extension position of the first barbell arm assemblies, while FIG. 7B is a retracted position of the first barbell arm assemblies.

FIG. 8A depicts side views of the first barbell arm assembly in an elbow plate extension and retracted position, FIG. 8B depicts a perspective view of the rear of the support frame with the first barbell arm assemblies attached, FIG. 8C-E depicts perspective views of the positioning and attachment of a first barbell arm assembly to a vertical support element.

FIG. 10A shows a connecting plate, FIG. 10B shows an upper mounting bracket, and FIG. 10C shows a lower mounting bracket.

FIG. 12A is a perspective view showing the attachment of second barbell arm assemblies to a support frame, FIG. 12B displays a side view of second barbell arm assemblies in an extension position, and FIG. 12C is a perspective view of second barbell arm assemblies in an extension position.

FIG. 14A shows the second barbell arm assemblies in an extension position, while FIG. 14B shows the second barbell arm assemblies in a retracted position.

FIG. 15A shows second barbell resting plate, holder, and mounting element disassembled, FIG. 15B shows a rear perspective view of the second barbell resting plate and holder, FIG. 15C shows second barbell resting plate, holder, and mounting element assembled, and FIG. 15D shows second barbell arm.

FIG. 16A is a perspective view of the connecting rod assembly as it appears when components are assembled, while FIG. 16B is an exploded view of the connecting rod assembly.

DETAILED DESCRIPTION OF INVENTION

The present invention is generally directed to dumbbell and barbell support systems and methods of making and using same. The systems include a pair of frames and extendable arm assemblies. In an exemplary embodiment of the invention, the system comprises extendable arm assemblies attached to frames, one assembly attached to each frame. The extendable arm assembly comprising two different cradles to hold a dumbbell or two different holders to hold a barbell. In such an embodiment, the dumbbells or barbells are placed on the extendable arm assemblies and are configured to be extended to a distance from the frames. Further, the distance of the extendable arm assemblies from the frames is adjusted per requirements of the user. In such an embodiment, the extendable arms automatically retract when the dumbbells or barbells are removed from the system.

For example, when a user, at an accessible distance from the system, performs exercises, the user accesses dumbbells or a barbell, places them in the cradles, and extend the extendable arm assemblies. The extendable arm assemblies are moved to the extension position from the retracted position to deliver the dumbbells or barbell. When the dumbbells or barbell are unloaded from the extended arm assemblies, the extendable arm assemblies automatically retract to clear the line of action of exercise. Therefore, the system enables the user to perform the exercise without having to move away from the system or seek the help of others to grab and lift the dumbbells or barbell. The retraction of the extendable arm assemblies is at a suitable distance such that the user can replace the dumbbells or barbell back onto the cradle without the help of others.

Figure 1:
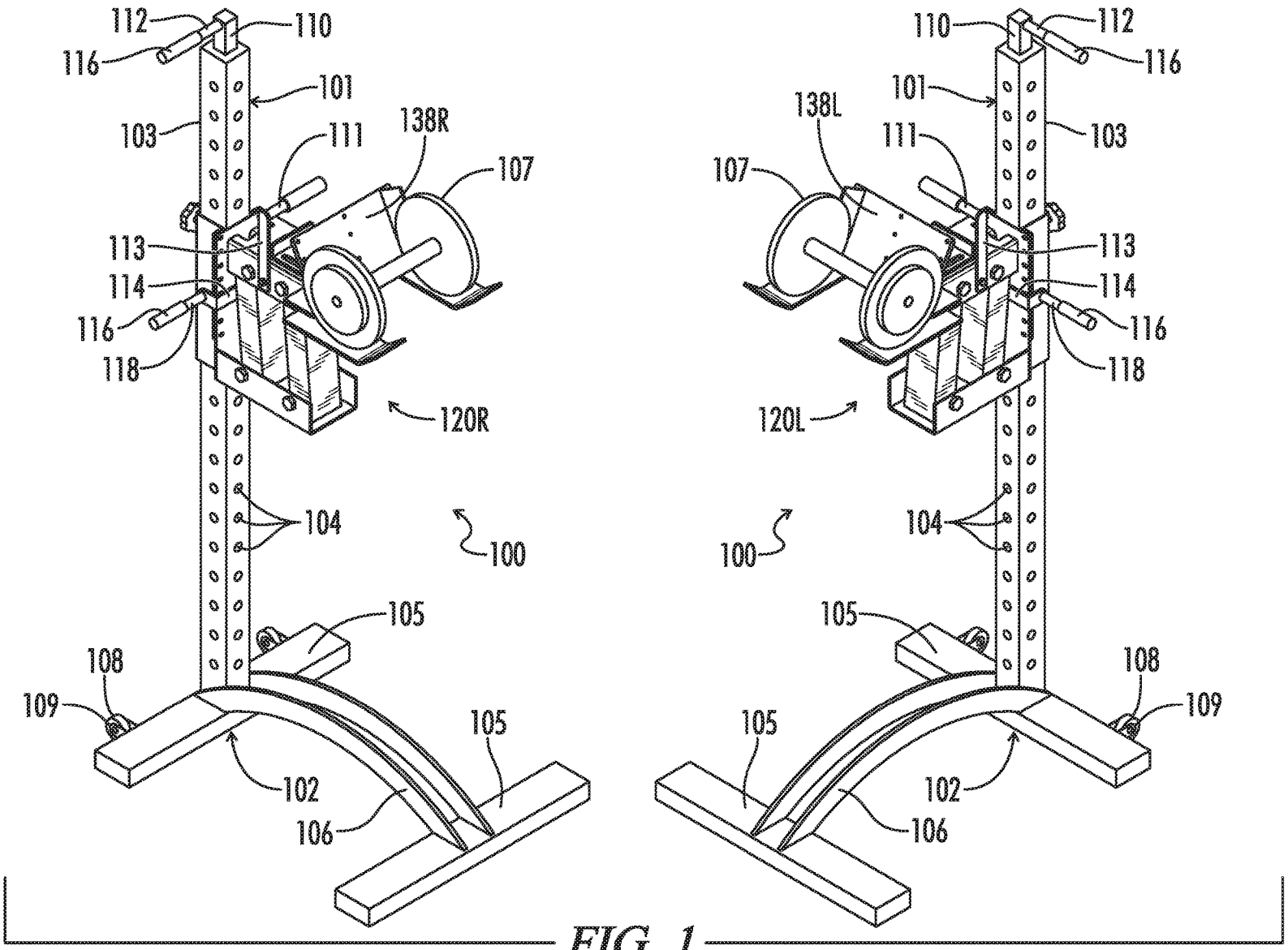
FIG. 1 is a perspective view of a first embodiment of a support system, showing a dumbbell support system.

FIG. 1 depicts a first embodiment of the invention, dumbbell support system 100. The system is a pair of frames 101 and extendable arm assemblies 120 R, 120 L. In an exemplary embodiment of the invention, the system comprises two extendable arm assemblies 120 R, 120 L attached to two frames 101, one assembly 120 attached to each frame 101, for each of the two dumbbells 107. Extendable arm assembly 120 comprises two different cradles to hold dumbbell 107, with one cradle located on a left side and one cradle located on a right side. In such an embodiment, dumbbells 107 placed on extendable arm assemblies 120 R, 120 L, are configured to be extended to a distance from frames 101. Further, dumbbells 107 are supported by system 100 when extendable arm assemblies 120 R, 120 L are at an extended distance from the frames (referred to as an extension position 130) also when extendable arm assemblies 120 R, 120 L retract back to frame 101 (referred to as a retraction position 129). Furthermore, extendable arm assemblies 120 R, 120 L automatically retract to retraction position 129 when dumbbells 107 are removed from system 100 at extension position 130, using one or more struts 154.

Dumbbell support system 100, in the depicted embodiment, delivers dumbbells 107 to the user at an accessible position that is suitable for the intended exercises and use of the user. System 100 is designed to accompany common commercial weight lifting benches, such as a military press bench, incline press bench, flat press bench, and decline press bench. System 100 is also configured to accommodate other such systems suitable for weight lifting exercises. Additionally, system 100 is compatible with situations where the user is in a wheelchair, the user utilizes a specialized seat or seat insert to accommodate disabilities, injuries or conditions, the user utilizes prosthetics, the user is a rehab patient seated or assisted by tables, and other accompaniments not listed.

As shown by FIG. 1, frames 101 comprises a base 102 and a vertical support element 103. Base 102 is configured to support system 100 and rests on the floor or ground. Vertical support element 103 is configured to extend from base 102 and includes a plurality of holes 104 to provide coupling means to extendable arm assemblies 120R, 120L. In the depicted embodiment, base 102 includes one or more horizontal elements 105 and a linking support element 106. Linking support element 106 is coupled to the horizontal element 105 at each end of the linking support element 106 and vertical support element 103 is attached to linking support element 106 of base 102. In some instances, base 102 further includes one or more wheels 108, wherein wheels 108 are hinged to a wheel clamping provision 109 that is attached to one or more of horizontal elements 105 of base 102. Wheels 108 in base 102 facilitate the motion of frames 101 to move between locations. Vertical support element 103 includes a vertical clamping provision 110 attached to the top of vertical support element 103 and a frame handle 112 coupled to vertical clamping provision 110, which is configured to facilitate holding and moving frame 101. Frame handle 112 includes a rubber grip 116 to facilitate better gripping and smooth handling of frame handle 112 in some instances. In the depicted embodiment, frame handle 112 is a hollow rod with circular cross-section, vertical clamping provision 110 is a bracket with one or more holes to receive frame handle 112, and frame handle 112 is coupled to vertical clamping provision 110 using one or more threaded bolts, wherein frame handle 112 comprises a threaded interior to receive the threaded bolt. Further, in the depicted embodiment, frame handle 112 is assembled such that grip 116 is positioned towards the outside of the frame 101. However, in other embodiments, other arrangements for holding and moving the frame 101 are possible, including different frame handle 112 and vertical clamping provision 110 sizes, shapes, and attachment means.

Further, in the depicted embodiment, vertical support element 103 and horizontal element 105 are hollow bars of a rectangular cross section. Linking support element 106 is a parallel arch beam and is connected to the horizontal elements 105. The parallel arch beam is configured in such a way to allow close proximity to the user by a design that is specifically intended to avoid the frames of weight benches that are used in conjunction with system 100. However, other cross sections and shapes of linking support element 106 and horizontal elements 105 are possible. Linking support element 106 is bolted with vertical support element 103 extending approximately perpendicular to a top surface of linking support element 106, with one or more threaded bolts used for attachment. In some embodiments, vertical support element 103 and base 102 have similar cross sections and shapes (e.g., a bar with square cross-section), however, in other embodiments these shapes and cross sections differ. In some embodiments, vertical support element 103 and base 102 are manufactured as a single unit. However, other configurations of base 102 and the vertical support element 103 and other coupling mechanisms are possible.

Figure 2A:
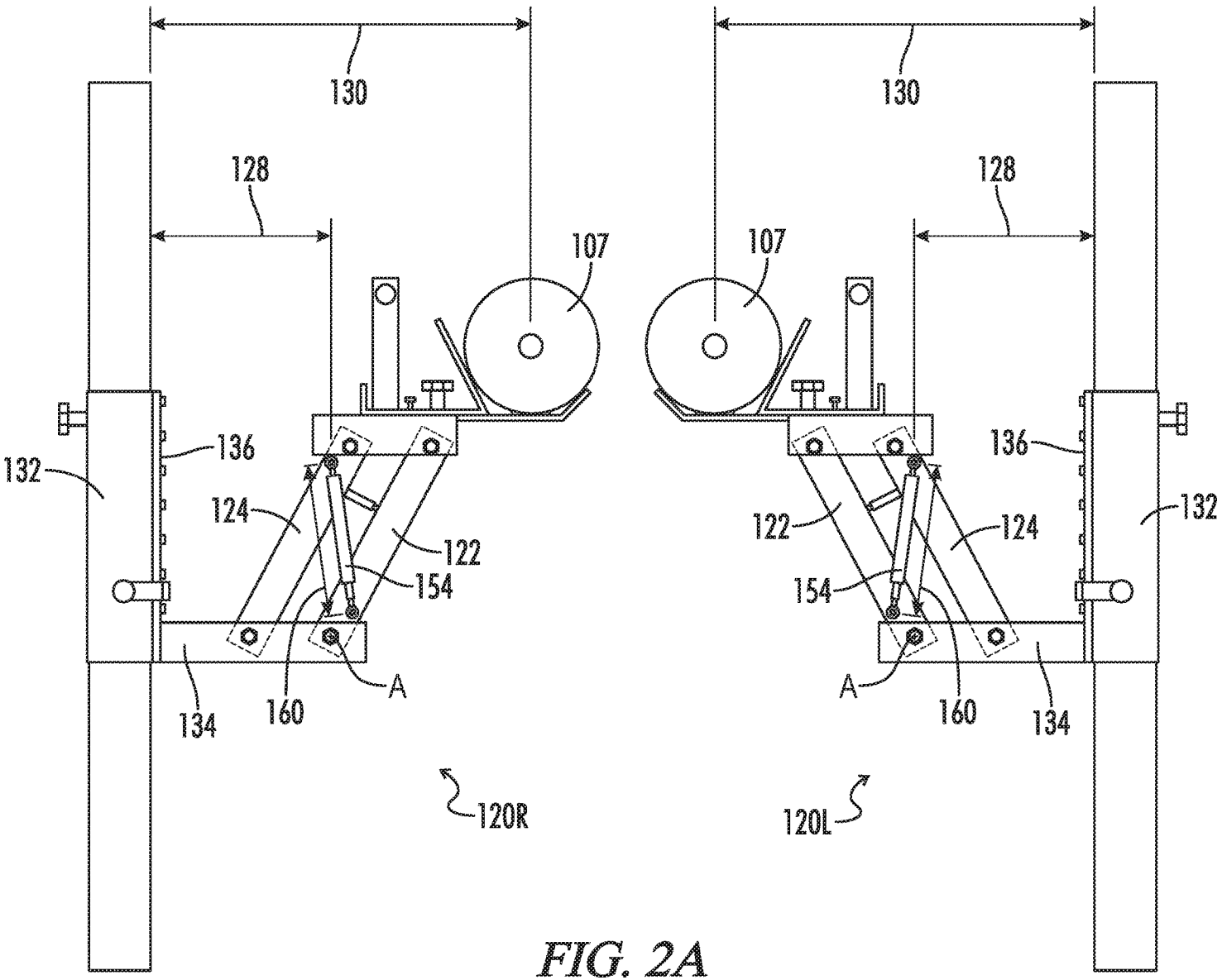
FIG. 2A-B are side views of the dumbbell support system of FIG. 1.
Figure 2B:
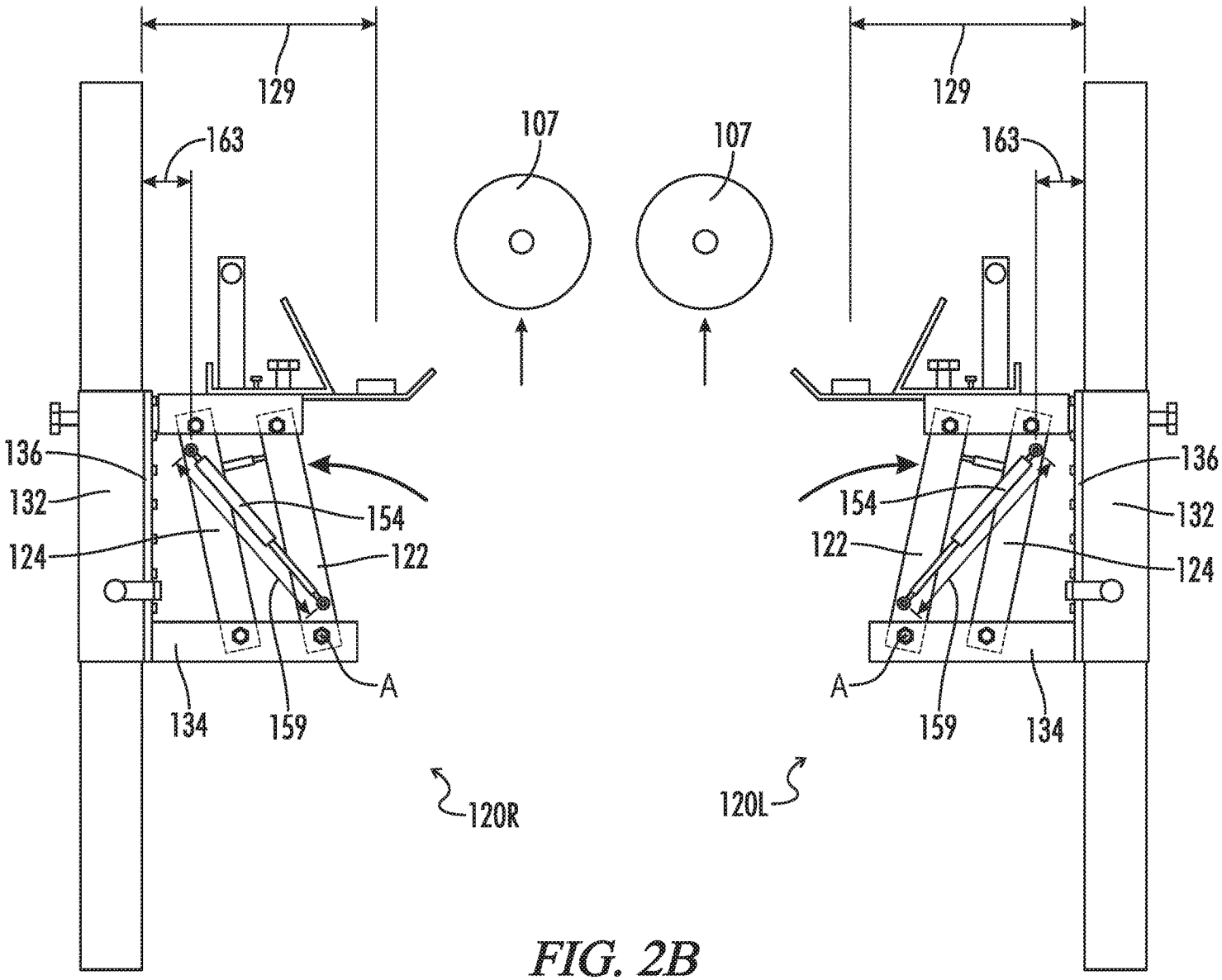

Referring to FIG. 2A-B, extendable arm assemblies 120R, 120L are depicted. Extendable arm assemblies 120R, 120L of system 100 comprise a front arm 122, a back arm 124, a mounting element 132, a resting plate 136, a holder 134 and a cradle 138R, 138L. Extendable arm assemblies 120R, 120L are configured to toggle to extension position 130 (FIG. 2A) and retracted position 129 (FIG. 2B). Extension position 130 denotes a position where arms 122, 124 are pivoted to a distance away from resting plate 136. Retracted position 129 denotes a position where arms 122, 124 are pivoted towards resting plate 136, such that back arm 124 rests on or near resting plate 136. Extendable arm assemblies 120R, 120L are installed onto frame 101 on vertical support element 103. In the depicted embodiment, one extendable arm assembly 120 is installed on each vertical support element 103. Further, the position of assembly 120 on vertical support element 103 is changed per requirements of the user, such as according to the user's height or requirements to perform an intended exercise. Positioning of each assembly 120 along vertical support element 103 is varied by mounting into different vertical support element holes 104. In some embodiments, more than one type of extendable arm assembly 120 is installed on vertical element 103.

In some embodiments, extendable arm assembly 120 is integrated with frame 101 and made as a single unit. In some embodiments, assembly 120 is permanently fixed at a position. However, in other embodiments, other configurations of extendable arm assembly 120 are possible.

Figure 3:
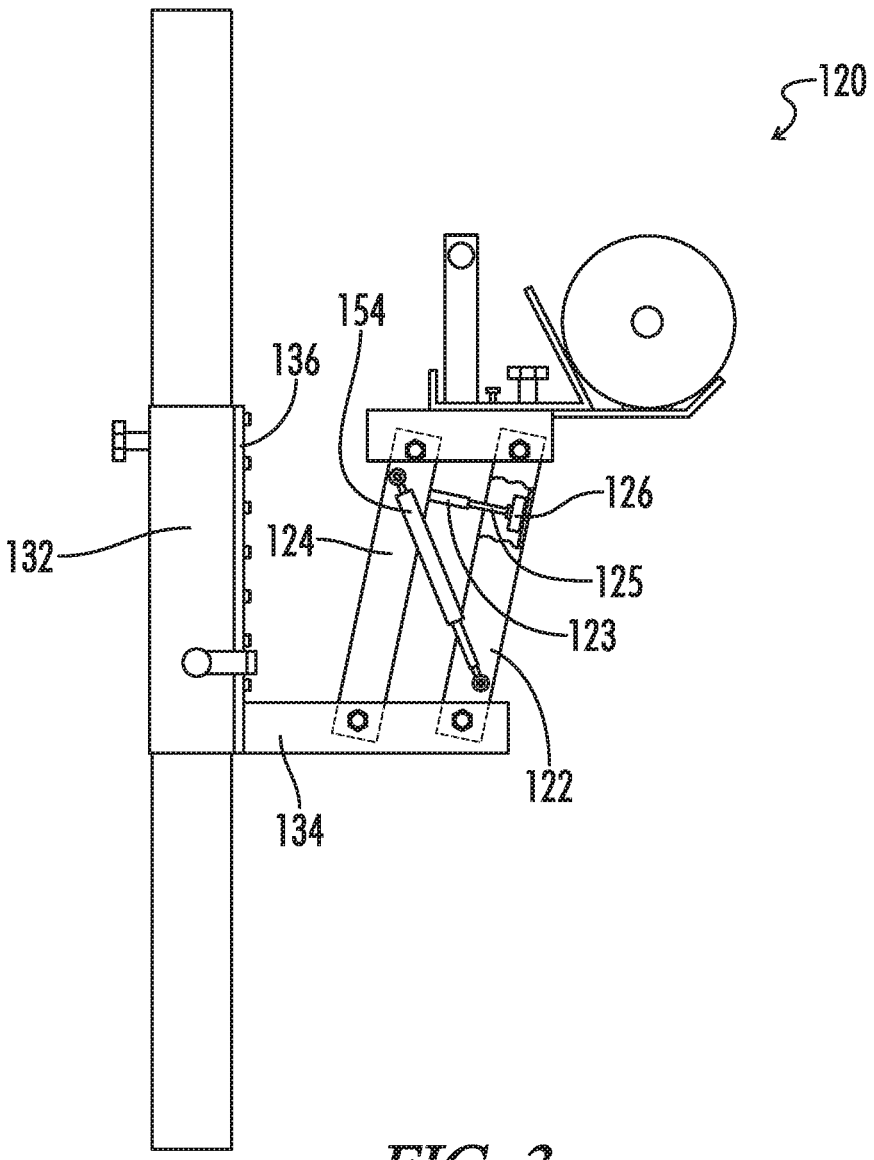
FIG. 3 is a partial sectional view of the dumbbell support system of FIG. 1 with the extendable arm assembly in an extension position.

As shown in FIGS. 2A-B and FIG. 3, front arm 122 and back arm 124 are configured to pivot, so that extendable arm assembly 120 extends to deliver dumbbell 107. Front arm 122 and back arm 124 are coupled, such that front arm 122 and back arm 124 pivot simultaneously. Front arm 122 and back arm 124 include one or more tubes and one or more coupling rods configured to be received into the tubes and one or more coupling provisions near the top and at the bottom of front arm 122 and back arm 124 to facilitate coupling and pivoting function of arms 122, 124. However, other coupling and pivoting means are compatible with the present invention. Back arm 124 includes a threaded coupler 123 that is welded on a surface of back arm 124 that faces front arm 122. A connected rod 125 is coupled with threaded coupler 123 and with a resting element 126, where resting element 126 is configured to rest on an inner surface of front arm 122 when in extension position 130, as shown in FIG. 3. Further, connected rod 125 is designed to be adjustable and to become shorter or longer for the purpose of increasing extension position 130 or decreasing extension position 130, respectively, as shown in FIG. 2A-B. In FIG. 2A, the decrease in connecting rod 125 length during extension of arm assembly 120 results in an extension zone 128, while in FIG. 2B the increase in connecting rod 125 length during retraction of arm assembly 120 results in a retraction zone 163.

In the depicted embodiment, front arm 122 and back arm 124 are u-shaped channels. In some embodiments, front arm 122 and back arm 124 are a single arm. In some embodiments, front arm 122 and back arm 124 include other arm shapes and cross sections (e.g., a hollow bar of rectangular cross-section). Further, in the depicted embodiment the tubes are hollow cylindrical tubes with one tube attached to the top and the bottom of each of front arm 122 and back arm 124. Coupling rods are hollow rods and the coupling of front arm 122 and back arm 124 is achieved using one or more threaded bolts. However, other coupling means are possible. Further, resting element 126 is, in the depicted embodiment, a rubber bush that is coupled to connecting rod 125 using one or more threaded bolts and nuts. Connecting rod 125 is coupled with arm 124 using threaded coupler 123 that is welded to arm 124. However, in other embodiments, other configurations and other types of front arm 122 and back arm 124 with other coupling mechanisms are possible.

Figure 4A:
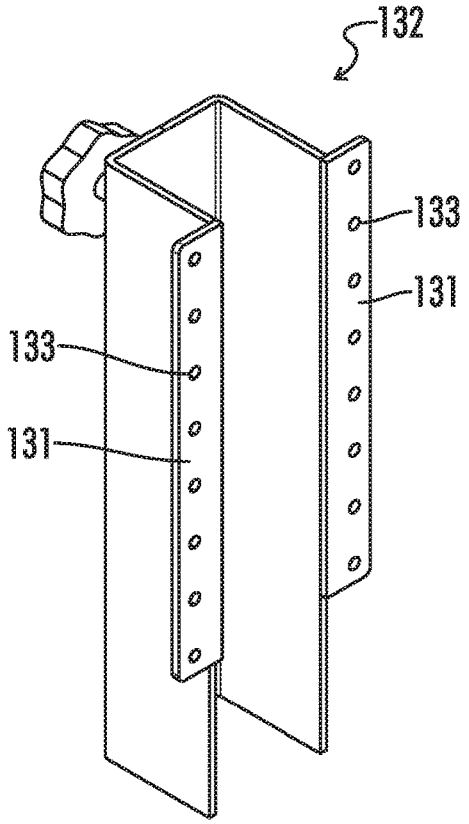
FIG. 4A-C are perspective views of support components for the dumbbell support system of FIG. 1.

Referring now to FIG. 4A, mounting element 132 is configured to facilitate the mounting of extendable arm assemblies 120R, 120L with frame 101. Mounting element 132 includes a plurality of mounting holes 133 to facilitate coupling with resting plate 136 of extendable arm assemblies 120R, 120L and one or more holes to affix mounting element 132 with frame 101. In the depicted embodiment, mounting element 132 is a u-section, with one or more mounting flanges 131 of mounting element 132 including mounting holes 133 to couple with resting plate 136 using one or more threaded bolts and nuts. The attachment of mounting element 132 with frame 101 is depicted in FIGS. 2A-B and is ensured by inserting a screw clamp through a hole on the web of mounting element 132. However, other attachment means to frame 101 are possible. In some embodiments not depicted, mounting element 132 is integrated with frame 101. In some embodiments, mounting element 132 has various shapes, cross sections, and sizes (e.g., a hollow bar of rectangular cross-section). However, in other embodiments, mounting element 132 includes other configurations with other coupling mechanisms.

Figure 4B:
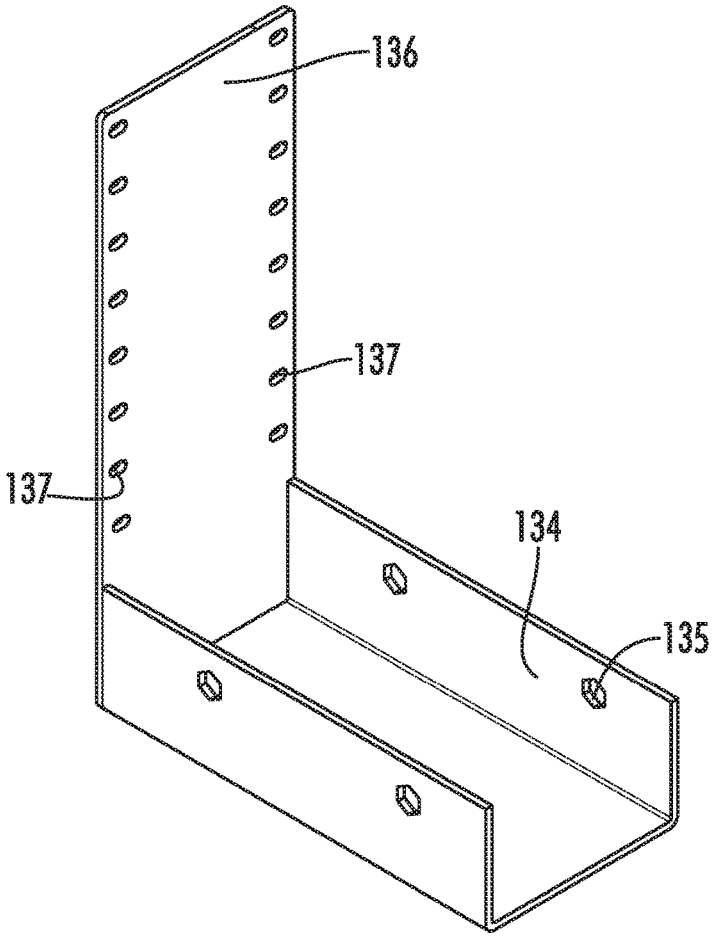

Resting plate 136, as depicted by FIGS. 2A-B and FIG. 4B, is configured to rest against mounting element 132 and facilitate the resting of back arm 124 in retracted position 129 of extendable arm assemblies 120R, 120L. Resting plate 136 includes a plurality of resting slots 137 to couple with mounting element 132 and a locking provision to facilitate locking of extendable arm assemblies 120R, 120L onto frame 101. The locking provision are a protruding cavity to accommodate a locking element. In the depicted embodiment, resting plate 136 is a plate with rectangular cross-section, although, in other embodiments, other shapes and sizes of resting plates are possible. Additionally, an indexing plunger is used as the locking element in some instances. Further, as extendable arm assemblies 120R, 120L are mounted onto frame 101, the indexing plunger locks extendable arm assemblies 120R, 120L into hole 104 of vertical support element 103 of frame 101. Assemblies 120R, 120L are configured to be unlocked by pulling the indexing plunger out of hole 104. Alternatively, in some embodiments, the locking provision and the locking element are not present and other locking and attachment means are utilized. In some embodiments, more than one locking provision and locking element are utilized. In some embodiments, a screw clamp is used as the locking element. However, in other embodiments, other configurations for locking assemblies 120R, 120L and other types of locking elements are possible.

In an exemplary embodiment, the position of extendable arm assemblies 120R, 120L on vertical support element 103 is per requirements of the user by unlocking the plunger from one of holes 104 in vertical element 103, unscrewing the screw clamp on mounting element 132, inserting the plunger into another hole 104 of vertical element 103 in order to lock the plunger onto the other hole 104, and tightening the screw clamp. Further, extendable arm assemblies 120R, 120L are temporarily or permanently removed from frame 101 by unlocking the plunger and unscrewing the screw clamp. However, in other embodiments, other configurations of installation or removal of assemblies 120R, 120L are possible.

Holder 134, as depicted by FIGS. 2A-B and FIG. 4B, is coupled to resting plate 136 proximate the locking provision of resting plate 136, and holder 134 is configured to hold arms 122, 124. Holder 134 includes plurality of holder holes 135 through which front arm 122 and back arm 124 are coupled to holder 134. In the depicted embodiment, holder 135 is a u-section channel and is welded to resting plate 136 and bolted with front arm 122 and back arm 124. Further, front arm 122 and back arm 124 are held inside the u-section channel and deflect together with respect to the points where holder 134 and front arm 122 and back arm 124 are coupled together. Front arm 122 and back arm 124 pivot with respect to the pivot axis A-A, as shown in FIG. 2A-B. In some embodiments, holder 134 is a solid bar and front arm 122 and back arm 124 are coupled to holder 134 on an outer surface of holder 134. In other embodiments, holder 134 has different shapes and cross sections and is coupled to front arm 122 and back arm 124 using other mechanisms.

Figure 5A:
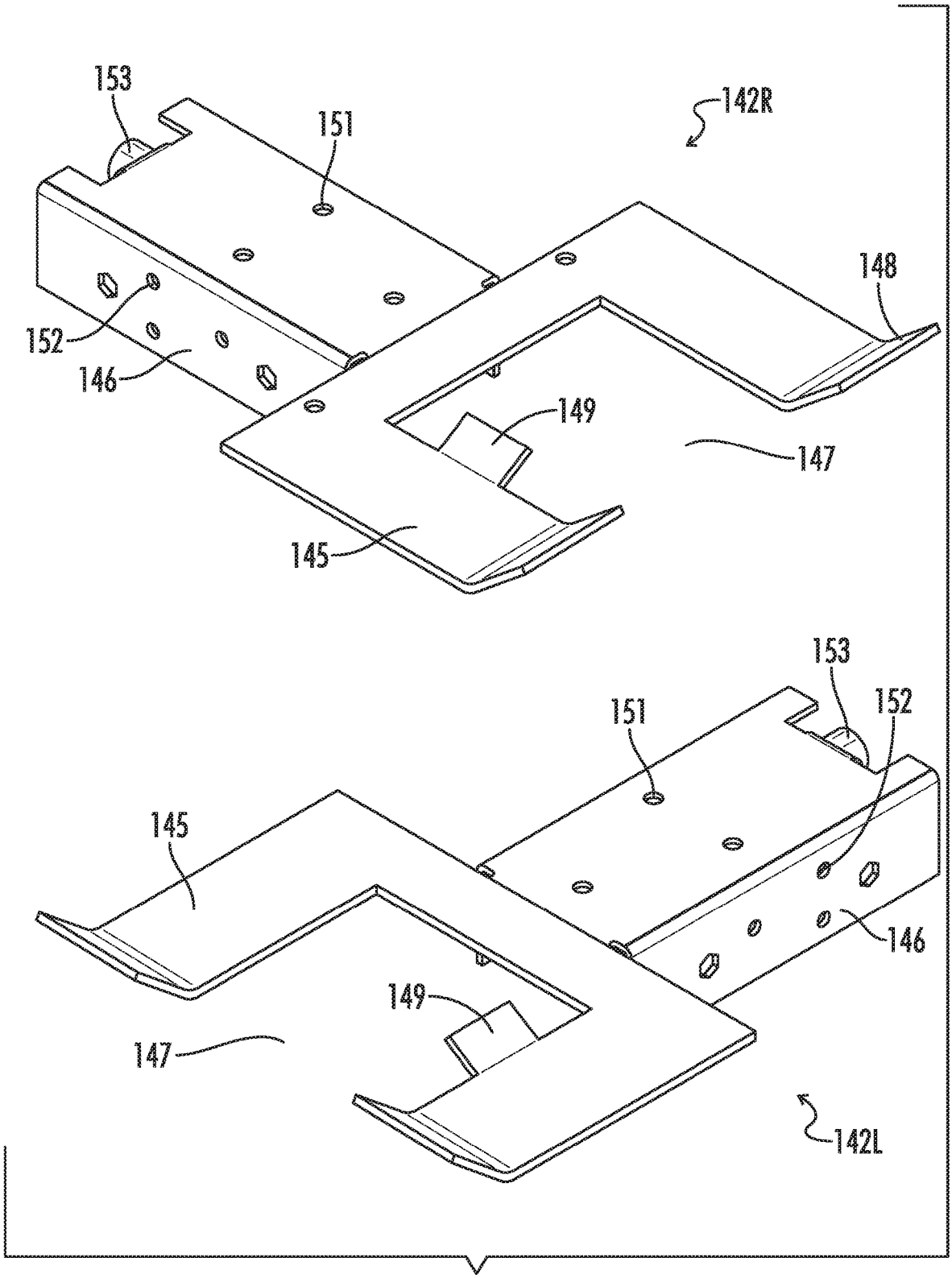
FIG. 5A-C are perspective views of the cradles and extendable arm assemblies of the dumbbell support system of FIG. 1.
Figure 5B:
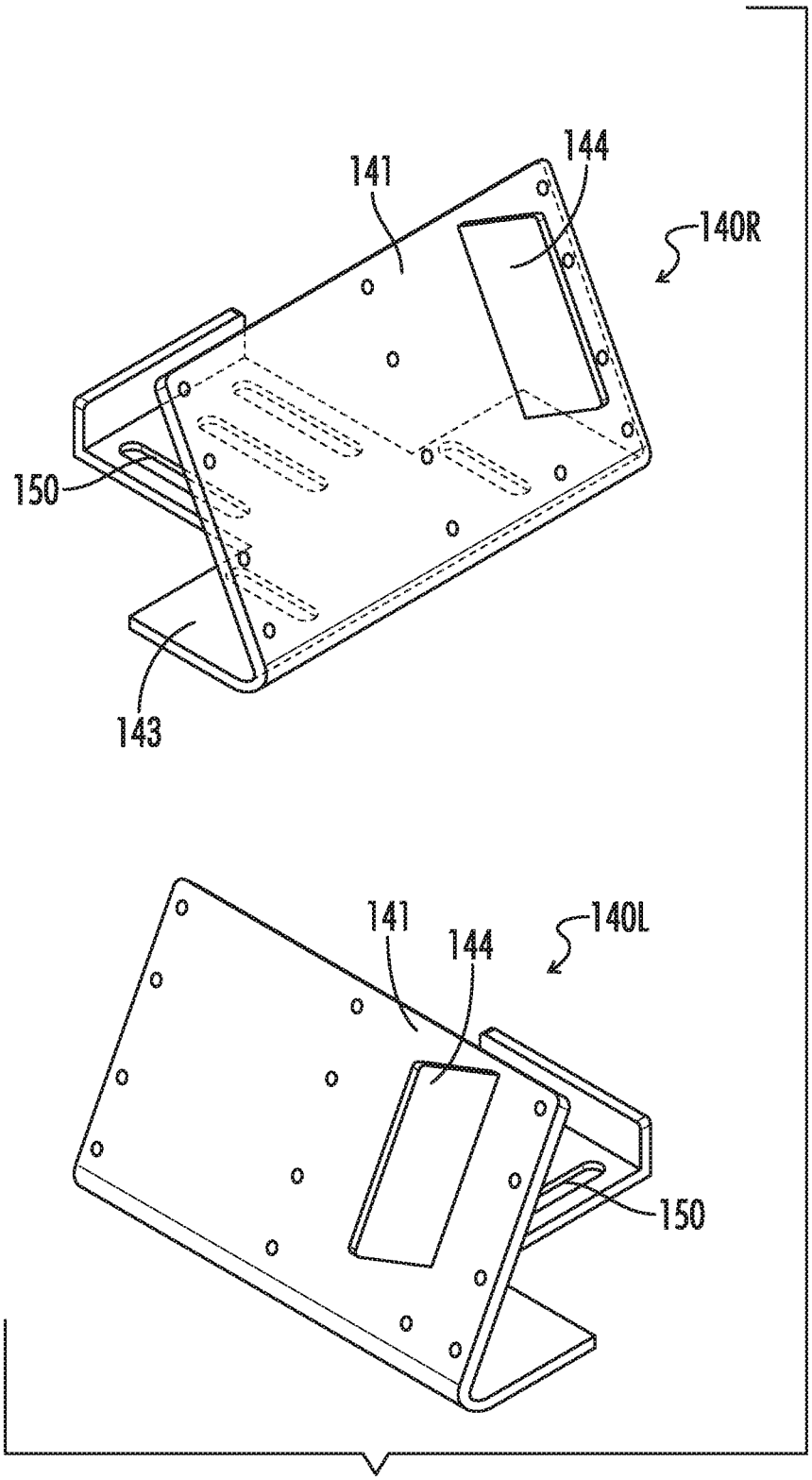
Figure 5C:
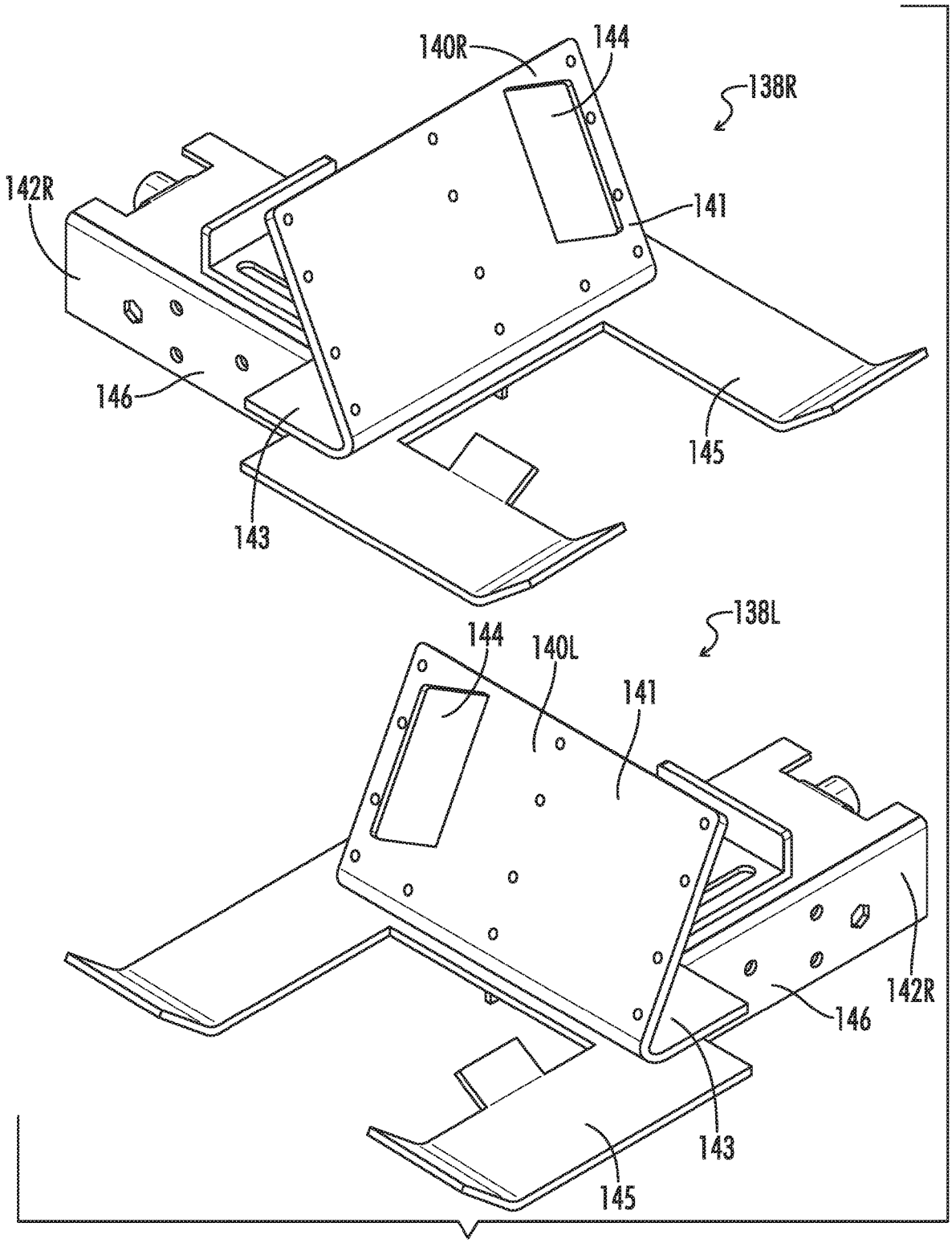

Cradles 138R, 138L, as shown by FIG. 1 and FIG. 5C, comprise upper cradle frames 140R, 140L (FIG. 5B) and lower cradle frames 142R, 142L (FIG. 5A), wherein upper cradle frames 140R, 140L and lower cradle frames 142R, 142L are coupled together (FIG. 5C). Upper cradle frames 140R, 140L comprise upper support members 141 and upper extension portions 143. Additionally, lower cradle frames 142R, 142L comprise lower support members 145 and lower extension portions 146. Upper support members 141 and upper extension portions 143 of upper cradle frames 140R, 140L, and lower support members 145 and lower extension portions 146 of lower cradle frames 142R, 142L are configured to support the load of dumbbell 107. Extension portions 143, 146 are configured to provide a coupling mechanism to arms 122 and 124. Lower extension portions 146 of lower cradle frames 142R, 142L extend from a rear of lower support members 145, wherein lower support members 145 and lower extension portions 146 are oriented facing toward the same direction. Upper extension portions 143 of upper cradle frames 140R, 140L extend from the bottom of upper support members 141, such that upper support members 141 are inclined relative to upper extension portions 143. In some embodiments, upper support members 141 and upper extension portions 143 are perpendicular to each other. However, in other embodiments, other arrangements and orientations of upper extension portions 143 and upper support members 141 are possible.

As shown in FIG. 5B, upper support member 141 includes a protrusion 144 on a front side of upper support member 141, wherein protrusion 144 provides additional support and securement for dumbbell 170. Protrusion 144 is configured to facilitate and ease the placing of dumbbell 107 onto cradles 138R, 138L, such that when the user places dumbbell 107 onto cradles 138R, 138L, is rests against protrusion 144 to dock dumbbell 107 on cradles 138R, 138L.

As shown in FIG. 5A, lower support member 145 includes a lower cut-out portion 147 to provide access to dumbbell 107. For example, for many exercises, the user removes dumbbell 107 from a position below system 100, and in such cases, lower cut-out portion 147 provides access to dumbbell 107. Lower support member 145 includes one or more raised lips 148 on a front end of lower support member 145 and a lower tab 149 proximate lower cut-out portion 147 configured to provide additional support and securement of dumbbell 107. Raised lips 148 and protrusion 144 of the support members 141, 145 prevent dumbbell 107 from falling off of cradles 138R, 138L. Raised lips 148 of lower support member 145 prevent dumbbell 107 from falling off of the front end of cradle 138R, 138L and protrusion 144 and lower tab 149 prevent dumbbell 107 from falling either through lower cut-out portion 147 or off the sides of cradles 138R, 138L. While the depicted embodiment includes one lower tab 149, two raised lips 148, and one protrusion 144, on both cradles 138R, 138L, other configurations are possible. For example, in configurations not depicted, the number of lower tabs 149, raised lips 148, and protrusions 144 are variable and include different shapes and sizes than those depicted. Further, in the depicted embodiments, protrusion 144 is proximate towards the center of upper support member 141 and lower tab 149 extends into lower cut-out portion 147. This configuration facilitates the performance of two-handed dumbbell exercises from both the right hand side and the left hand side of system 100. For instance, a user is able to access system 100 when it is located behind the user.

In an exemplary embodiment, support members 141, 145 are flat plates of a rectangular cross-section. In some embodiments, support members 141, 145 are hollow bars, and in some other embodiments, support members 141, 145 are a solid bar with slots for placing dumbbell 107. In other embodiments, other configurations and shapes of support members 141, 145 are possible.

Upper extension portion 143 includes one or more upper slots 150 to provide coupling means for upper cradle frames 140R, 140L and lower cradle frames 142R, 142L. Lower extension portion 146 of lower cradle frames 142R, 142L includes one or more lower holes 151 to couple with upper cradle frames 140R, 140L and one or more lower handle holes 152 to receive a cradle handle 111, as is described in detail later. Lower extension portion 146 is configured to be coupled with front arm 122 and back arm 124, such that front arm 122 and back arm 124 pivot together to facilitate the extension function of extendable arm assemblies 120R, 120L. Further, lower extension portion 146 has a stoppage element 153 attached to a back of lower extension portion 146, which is configured to stop the pivot motion of arms 122, 124 as stoppage element 153 hits resting plate 136 in retracted position 129 and is configured to absorb vibration whenever extendable arm assembly 120 retracts. In the depicted embodiment, upper extension portion 143 is a T-junction plate with rectangular cross-section and lower extension portion 146 is u-section channel. Rubber bush is used as stoppage element 153 and is coupled to lower extension portion 146 using one or more threaded bolts. In some embodiments, the extension portions 143, 146 are a solid bar, while in some embodiments, the extension portions 143, 146 are a hollow bar. However, in other embodiments, other configurations and shapes of extension portions 143, 146 are possible.

Adjustable cradles 138R, 138L, as depicted in FIG. 5C, have upper slots 150 that allow adjustment of the position of upper cradle frames 140R, 140L with respect to lower cradle frames 142R, 142L. As a result, different sizes of dumbbells 107 are compatible with the present system 100. Further, dumbbell 107 is secured in a 'set position' by placing dumbbell 107 on cradles 138R, 138L, adjusting the position of upper cradle frames 140R, 140L relative to lower cradle frames 142R, 142L to accommodate dumbbell 107 on cradles 138R, 138L, and locking the position of upper cradle frames 140R, 140L with respect to lower cradle frames 142R, 142L. Dumbbell 107 does not move on or out of cradles 138R, 138L in the set position, thereby ensuring safety of system 100.

In the depicted embodiment, upper cradle frames 140R, 140L and lower cradle frames 142R, 142L are coupled using one or more shoulder screws via the slots 271 and the holes 270, and the locking of the position of the upper frames 261R, 261L with respect to the lower frames 262R, 262L may be facilitated by screw clamp 179. In other embodiments, other configurations and other kinds of coupling and locking mechanisms are possible.

Figure 4C:
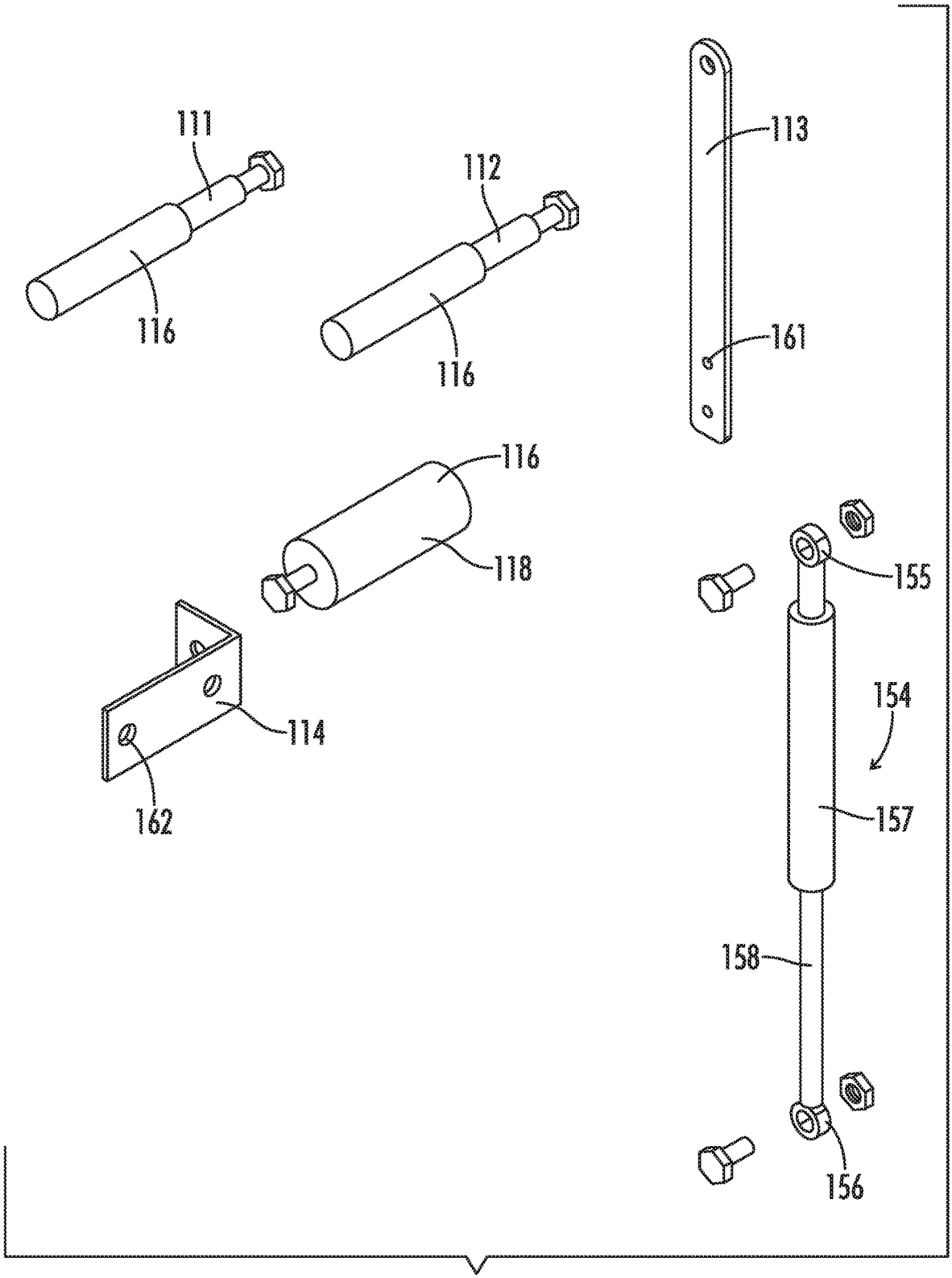

A strut 154 of extendable arm assemblies 120R, 120L, as depicted by FIGS. 2A-B and FIG. 4C, is configured to constrain the motion of front 122 and back arm 124 and facilitate the automatic retraction of extendable arm assemblies 120R, 120L. Strut 154 includes an upper strut mount 155, a lower strut mount 156 and a strut tube 157. Upper strut mount 155 and lower strut mount 156 are configured to couple strut 154 with front arm 122 and back arm 124, wherein upper strut mount 155 is coupled proximate at the top of back arm 124 and lower strut mount 156 is coupled proximate at the bottom of front arm 122. Strut tube 157 is configured to contain a piston head, a strut piston rod 158, a seal, and pressurized gas. The pressurized gas is at the top of strut tube 157, followed by the piston head being connected with piston rod 158. The seal is configured to prevent the pressurized gas from leaking out of strut 154. Piston rod 158 is configured to slide in and out of strut tube 157, upon addition or removal of load. When there is load acting on strut 154, the piston head pushes the pressurized gas up inside strut tube 157 and piston rod 158 slides into strut tube 157, constituting a retracted piston position 160 (FIG. 2A). When there is no load acting on strut 154 or on removal of the external load, the pressurized gas filled in the top portion of strut tube 154, forces the piston head down strut tube 157 and hence, piston rod 158 is extended out of strut tube 157, constituting an expanded piston position 159 (FIG. 2B) of strut 154. In an exemplary embodiment, strut 154 is coupled with front 122 and back arm 124 in expanded piston position 159. In the depicted embodiment, the upper 155 and lower strut mount 156 are ball sockets attached to arms 122, 124 of system 100. However, in other embodiments, other configurations of strut 154 are used.

Referring back to FIG. 1, extendable arm assemblies 120R, 120L include one or more brackets 113, 114 and one or more handles 111,118 coupled with brackets 113,114 to facilitate handling of extendable arm assemblies 120R, 120L. A cradle handle 111 is configured to help extendable arm assemblies 120R, 120L extend away from frame 101 or move towards frame 101. A cradle handle bracket 113 includes one or more cradle handle bracket holes 161 and is coupled to a top surface of lower cradle frames 142R, 142L using lower holes 151. Cradle handle bracket 113 is an angled bracket and cradle handle 111 is a hollow rod with circular cross-section. Cradle handle 111 includes a rubber grip 116 to facilitate better gripping and smooth handling of cradle handle 111. Cradle handle bracket 113 is coupled with lower cradle frames 142R, 142L and cradle handle 111 using one or more threaded bolts, wherein cradle handle 111 is threaded inside to receive the threaded bolts.

A bottom arm bracket handle 118 is configured to help the movement of extendable arm assemblies 120R, 120L vertically, such that extendable arm assemblies 120R, 120L are moved along vertical support element 103 of frame 101 as a means of height adjustment. Further, bottom arm bracket handle 118 facilitates installation or removal of extendable arm assemblies 120R, 120L on frame 101. A bottom arm bracket 114, coupled with bottom arm bracket handle 118, includes one or more bottom arm bracket holes 162 and is coupled to resting plate 136, using resting slots 137. Bottom arm bracket 114 is an angled bracket and bottom arm bracket handle 118 is a hollow rod with circular cross-section. Bottom arm bracket handle 118 further includes a rubber grip 116 to facilitate better gripping and smooth handling of the handle. Bottom arm bracket 114 is coupled with resting plate 136 and bottom arm bracket handle 118 using one or more threaded bolts, wherein bottom arm bracket handle 118 is threaded inside to receive the threaded bolts. However, in other embodiments, there may be other configurations to facilitate the handling of extendable arm assemblies 120R, 120L.

In the depicted embodiment, cradle handle bracket 113 is coupled to lower cradle frames 142R, 142L, to the outside of lower cradle frames 142R, 142L, and cradle handle 111 is assembled such that grip 116 points towards the inside of frame 101, and bottom arm bracket 114 is coupled to resting plate 136 such that it points towards the outside and is assembled to facilitate coupling of bottom arm bracket handle 118 towards the outside of frame 101. These are configured to facilitate both the right hand side and the left hand side respectively of system 100 in performing two-handed dumbbell exercises in many scenarios.

FIG. 2A depicts system 100 at extension position 130 and FIG. 2B depicts system 100 in retracted position 129 of assemblies 120R, 120L. In the depicted embodiment, assemblies 120R, 120L are extended along with dumbbell 107 on cradles 138R, 138L wherein when dumbbell 107 is placed on system 100 at retracted position 129, the load of dumbbell 107 is supported by frame 101. Further, assembly 120R, 120L is configured to be moved by the user away from frame 101. As assembly 120R, 120L is moved, strut 154, initially in expanded strut position 159, starts compressing, until assembly 120R, 120L reaches its extension position 130, and assembly 120R, 120L is unable to be extended further. In extension position 130 of assembly 120R, 120L, the load of dumbbell 107 is acting on strut 154 and assembly 120R, 120L stays in extension position 130 as long as dumbbell 107 is placed in assembly 120R, 120L. When dumbbell 107 is lifted from system 100, strut 154 reverts to expanded strut position 159 and thereby assemblies 120R, 120L retract to retracted position 129.

System 100 has parts that can and will be used on both left and right sides of the system. Additionally, system 100 has parts that must only be used on the side it was designed for, either the left side or the right side. Right side only parts are 138R, 140R and 142R. Left side only parts are 138L, 140L and 142L. All other parts are designed to be used on both the left and right hand sides.

Dumbbell support system 100, as depicted in FIG. 1, is designed to move in a multitude of directions in order to fully facilitate the use of two-hand dumbbells. System 100 has a left side and a right side that move independently. The individual right and left sides provide a unique ability to traverse the Z plane independent of each other. The individual right and left sides provide a unique ability to traverse the X plane independent of each other. The individual right and left sides are height-adjustable, providing a unique ability to traverse the Y plane independent of each other. The individual right and left side design includes a base with unique linking support elements 106 to allow close proximity to the user throughout the Z plane of motion. The individual right and left side design allows specific placement of either the left side or the right side per the requirements of the user. For instances an arm amputee with a prosthetic arm could require a variance for one side or the other as well, as could many other users that have specific needs.

Figure 6:
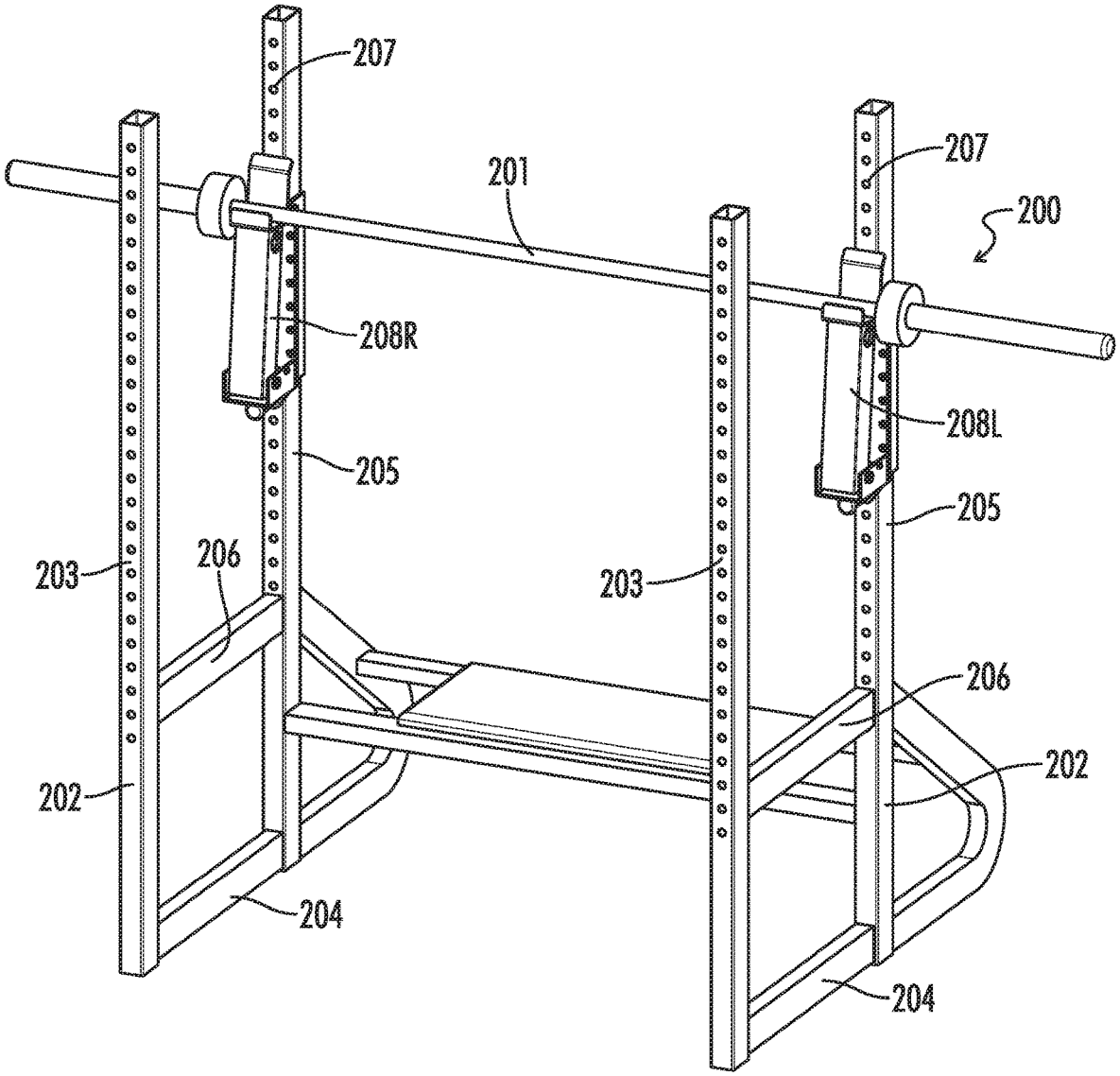
FIG. 6 is a perspective view of a second embodiment of a support system, displaying a first barbell support system.

In FIG. 6, a second embodiment of the invention is shown as the first barbell support system 200. In an exemplary embodiment of the invention, system 200 comprises a pair of extendable first barbell arm assemblies 208R, 208L attached to first barbell support frames 202. The pair of first barbell arm assemblies 208R, 208L are identical in most cases. System 200 is intended to be an improvement to or an attachment to preexisting weight bench presses of all types, as well as weight lifting racks of all types and weight machines of all types, but not to exclude any devices that could be made in the future. First barbell arm assemblies 208R, 208L comprise first barbell arm cradles 231, to hold a barbell 201. In such an embodiment, barbell 201 is placed on first barbell arm assemblies 208R, 208L, which are extended to a distance away from the frame (referred to as the first barbell extension position 228). Barbell 201 is supported by system 200 at first barbell extension position 228. Furthermore, when barbell 201 is removed from system 200 at extension position 228, first barbell arm assemblies 208R, 208L retract back to first barbell support frame 202 (referred to as the first barbell retracted position 229). Barbell 201 is supported at first barbell retracted position 229.

For example, when a user, at an accessible distance from system 200, performs exercises, the user places barbell 201 in first barbell arm cradle 231 while first barbell arm assemblies 208R, 208L are at retracted position 229. The user extends first barbell assemblies 208R, 208L to first barbell extension position 228 to deliver barbell 201. When the user begins the exercise, barbell 201 is unloaded from first barbell arm assemblies 208R, 208L and automatic retraction of first barbell arm assemblies 208R, 208L clears the line of action of exercise. Therefore, system 200 enables the user to perform the exercise without having to move away from system 200 or seek the help of others to grab and lift barbell 201. The retraction of first barbell arm assemblies 208R, 208L is at a distance such that the user is capable of replacing barbell 201 back onto first barbell arm cradles 231 without the help of others.

FIG. 6 depicts an exemplary embodiment of first barbell support system 200. System 200 for supporting barbell 201 comprises first barbell support frame 202 and first barbell arm assembly 208. First barbell support frame 202 is configured to provide a supporting function of system 200 and first barbell arm assembly 208 is configured to move to first barbell extension position 228 (FIG. 7A) or first barbell retracted position 229 (FIG. 7B), as is described in detail later.

First barbell support frame 202 comprises a first barbell base 204, one or more first barbell front vertical elements 203, one or more first barbell rear vertical elements 205 and one or more first barbell support plates 206. First barbell front vertical elements 203 and first barbell rear vertical elements 205 are parallel to each other and separated by a longitudinal distance. First barbell front vertical elements 203 are parallel to each other and separated by a distance in a lateral direction. First barbell front vertical elements 203 and first barbell rear vertical elements 205 rest on first barbell support base 204, which rests on the floor or ground. First barbell support plates 206 connect first barbell front vertical elements 203 with first barbell rear vertical elements 205 and first barbell rear vertical elements 205 with first barbell support base 204 on a rear side of first barbell rear vertical elements 204, as shown by FIG. 6. First barbell support plates 206, connecting first barbell front 203 and rear vertical frames 205, are displaced at a perpendicular distance vertically. First barbell front 203 and rear vertical elements 205 and first barbell support plates 206 include plurality of first barbell support frame holes 207 to facilitate coupling.

In an exemplary embodiment, first barbell support base 204, first barbell front 203 and rear vertical elements 205, and first barbell support plates 206 are hollow tubes with a rectangular cross section. However, other shapes and cross sections are possible. First barbell front 203 and rear vertical elements 205 are welded to first barbell support base 204, first barbell support plates 206 being attached to first barbell vertical elements 203, 205 by welding, and first barbell support plates 206 connecting first barbell rear vertical elements 205 with first barbell support base 204 also being welded. In some embodiments, first barbell support base 204, first barbell front 203 and rear vertical elements 205 and first barbell support plates 206 are a solid tube. In some embodiments, first barbell support frame 202 includes multiple first barbell vertical elements 203, 205 resting on first barbell support base 204. In some embodiments, first barbell support frame 202 is manufactured as a single unit. However, in other embodiments, other configurations of first barbell support frame 202 and other coupling mechanisms are possible.

Figure 8A:
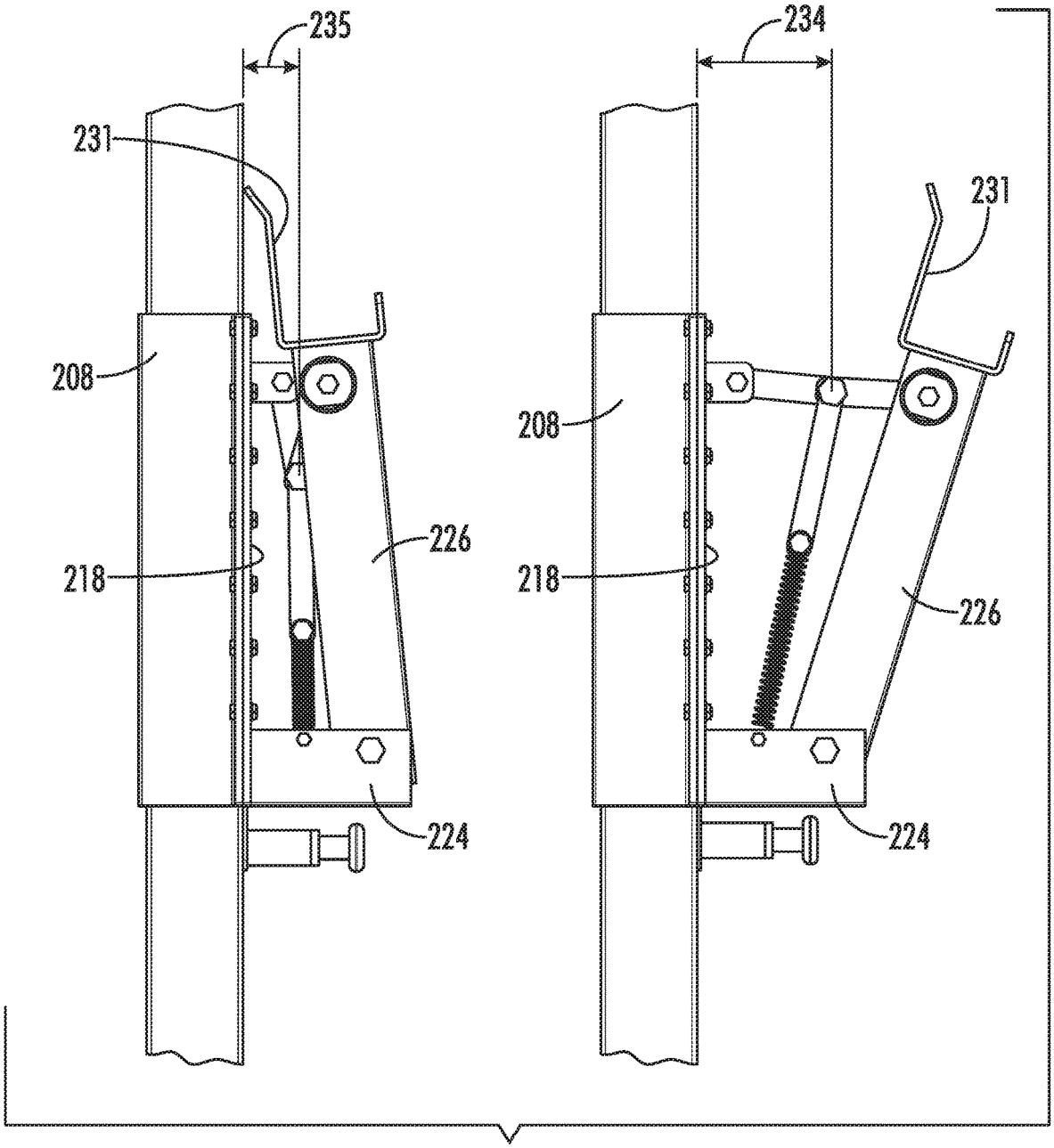
FIG. 8A-E are views of the first barbell support system of FIG. 6 attached to a barbell support frame.
Figure 8B:
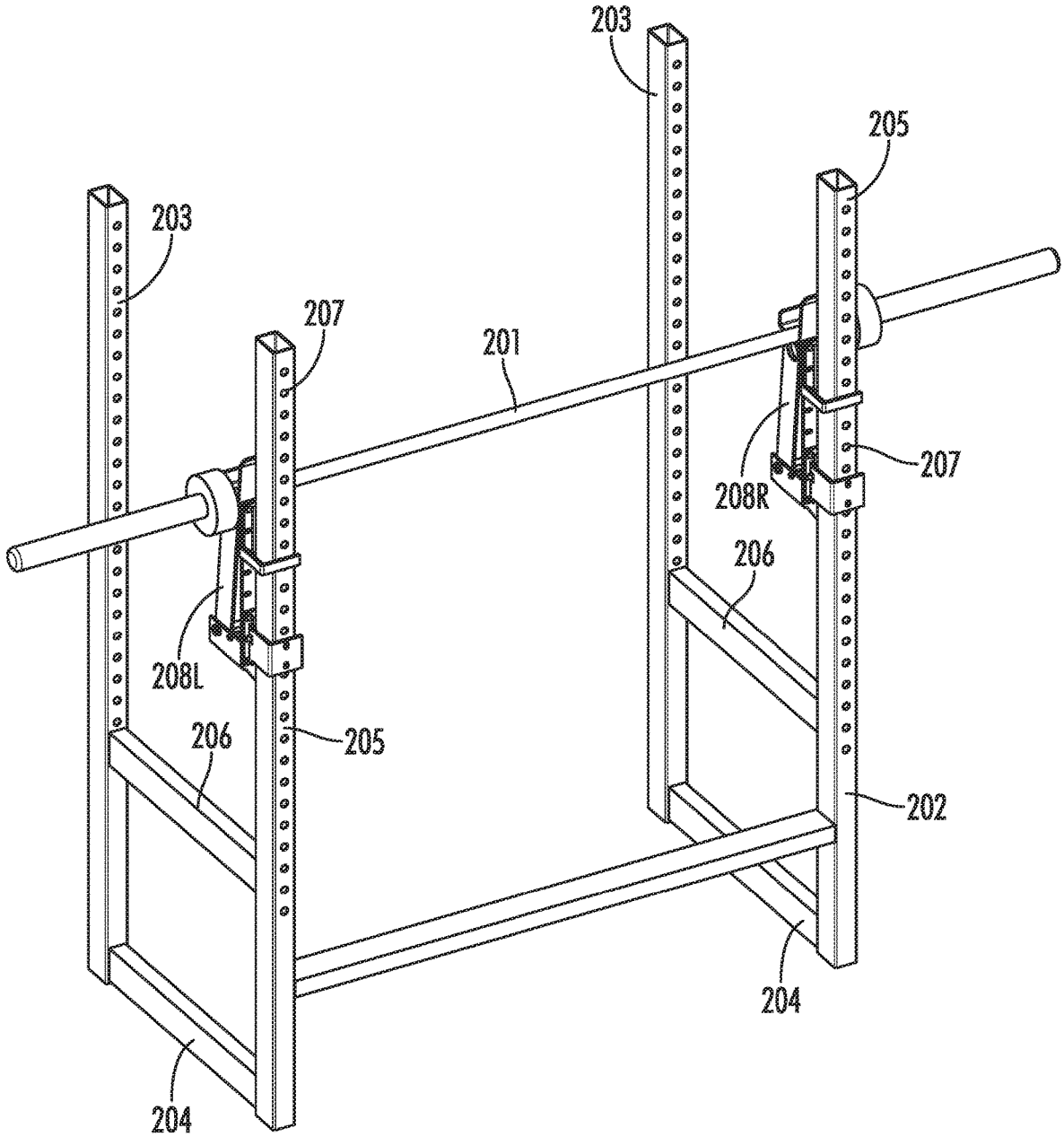
Figure 8C:
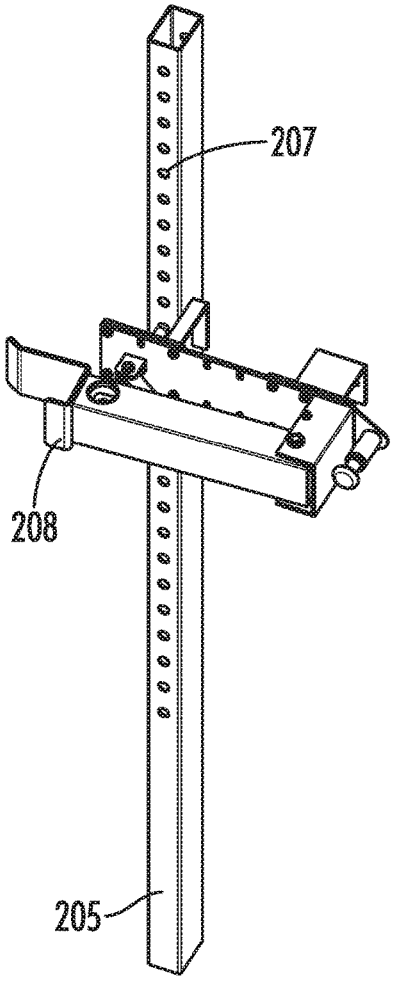
Figure 8D:
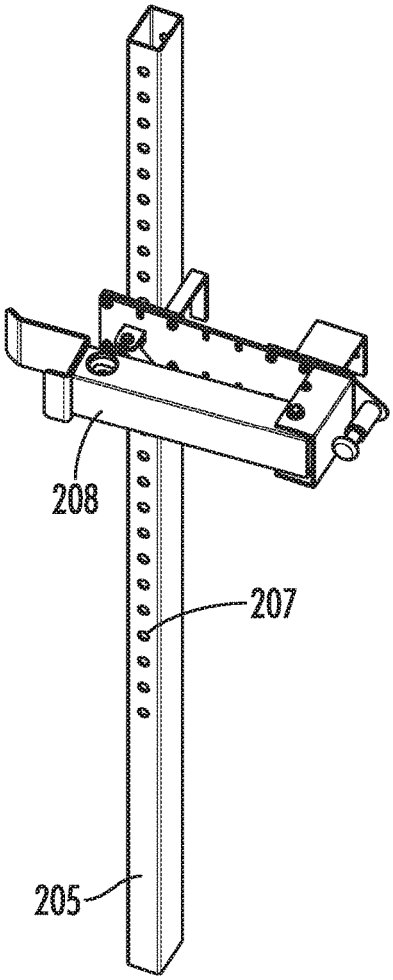
Figure 8E:
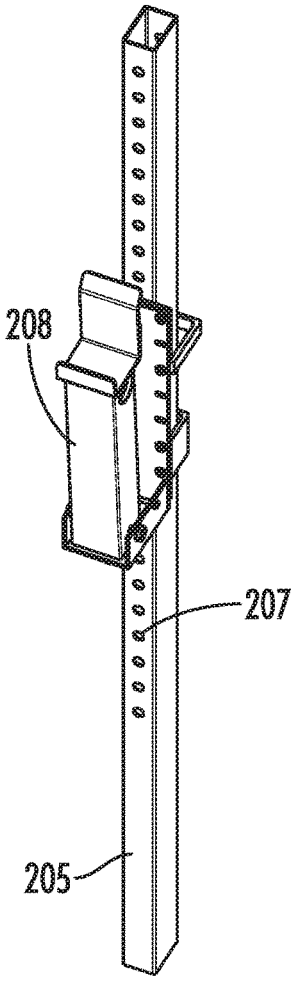
Figure 9:
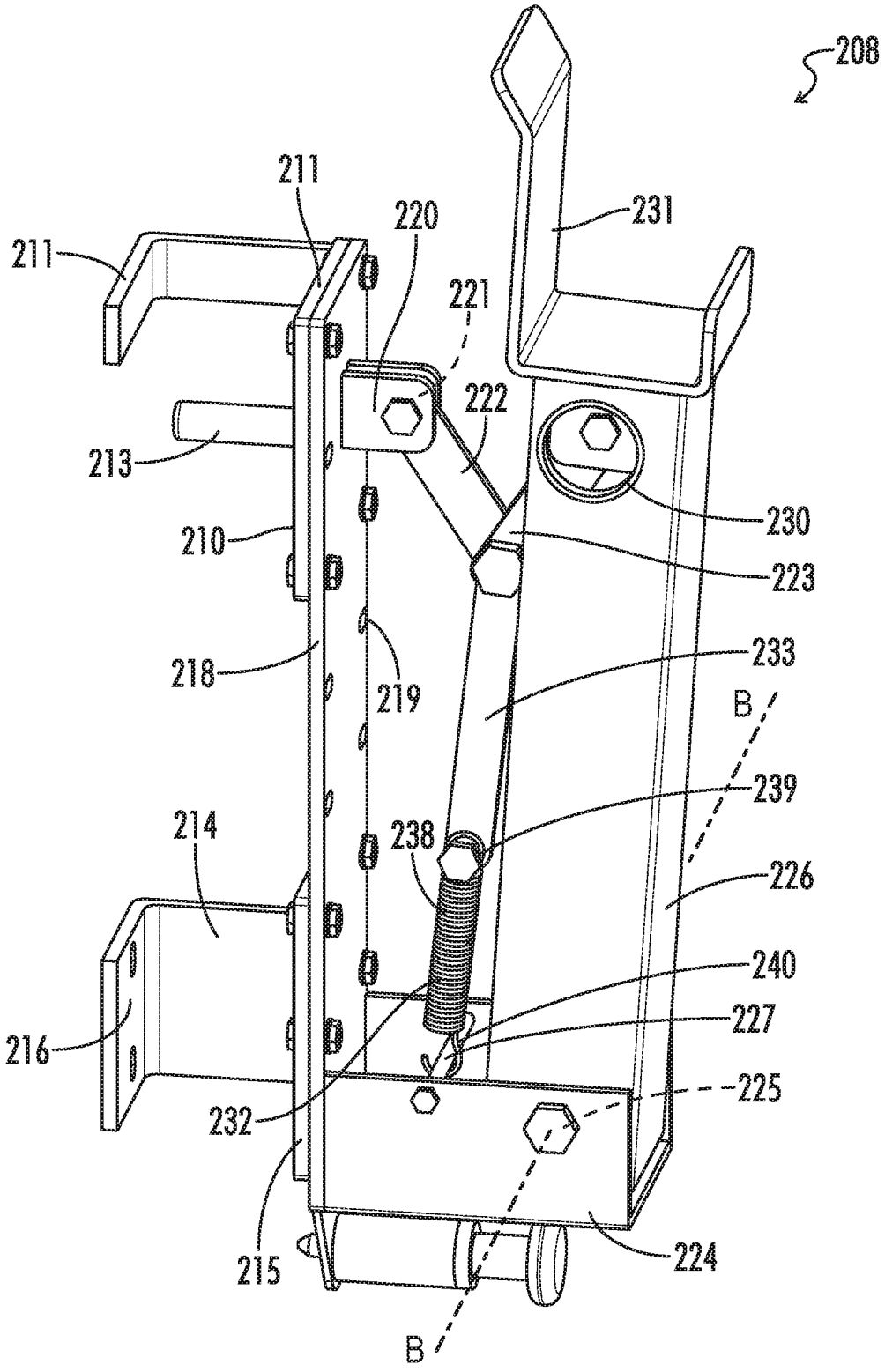
FIG. 9 is a perspective view of a first barbell arm assembly of the first barbell support system of FIG. 6 with a detailed view of components.

FIG. 8A and FIG. 9 depict extendable first barbell arm assemblies 208. First barbell arm assemblies 208R, 208L include a first barbell upper mounting bracket 210, a first barbell lower mounting bracket 214, a first barbell resting plate 218, a first barbell holder 224, a first barbell arm 226, one or more first barbell elbow plates 222, 223, an extension spring 232 and a first barbell connecting plate 233. First barbell arm assembly 208 is configured to toggle to first barbell extension position 228 (FIG. 8A, left) and first barbell retracted position 229 (FIG. 8A, right). First barbell extension position 228 denotes a position where first barbell arm 226 is pivoted to a maximum allowable distance away from first barbell assembly 208. First barbell retracted position 229 denotes a position where first barbell arm 226 is pivoted towards and rests on first barbell support frame 202. First barbell arm assemblies 208R, 208L are installed onto first barbell support frame 202 on first barbell front 203 or rear vertical elements 205, as shown in FIG. 8B. In the depicted embodiment, one first barbell arm assembly 208 may be installed on each of first barbell rear vertical elements 205. Further, the position of first barbell assembly 208 on first barbell vertical elements 203, 205 is adjustable based on requirements of the user and the exercises to be performed. For instance, as shown in FIG. 8C, first barbell assembly 208 is installed at a desired height on first barbell support frame 202 by aligning a coupling peg 213 with a first barbell support frame hole 207. Next, in FIG. 8D, coupling peg 213 is inserted into first barbell support frame hole 207, and first barbell assembly 208 is rotated into position in FIG. 8E. In some embodiments, first barbell arm assemblies 208R, 208L are integrated with first barbell support frame 202 and made as a single unit. In some embodiments, first barbell assemblies 208R, 208L are permanently fixed at a position on first barbell support frames 202. However, in other embodiments, other configurations of first barbell arm assemblies 208R, 208L are possible.

As shown in FIG. 8A, first barbell upper 210 and lower mounting brackets 214 are configured to mount first barbell arm assemblies 208 to first barbell vertical elements 203, 205. As shown in FIG. 10B, first barbell upper mounting bracket 210 includes a first barbell upper mounting bracket plate 209 and a first barbell upper mounting bracket mounting flange 211. First barbell upper mounting bracket plate 209 is of a rectangular shape and coupled to one end of first barbell vertical element 203, 205. First barbell upper mounting bracket flange 211 extends from first barbell upper mounting plate 209 and is configured to provide support to first barbell upper mounting bracket 210 from the other end of first barbell vertical elements 203, 205. First barbell upper mounting bracket flange 211 is an 'L-shaped' arm that is coupled with first barbell upper mounting bracket plate proximate to a lower end of first barbell upper mounting bracket plate 209. First barbell upper mounting bracket plate 209 also includes a plurality of first barbell upper mounting bracket holes 212 and coupling peg 213 to couple to first barbell resting plate 218 and first barbell vertical element 203, 205 respectively. Coupling peg 213 is a rod with circular cross-section extending from first barbell upper mounting bracket plate 209, which is configured to be inserted into first barbell support frame holes 207 in first barbell vertical elements 203, 205. The diameter of coupling peg 213 is chosen such that coupling peg 213 forms a snug fit when inserted into first barbell support frame holes 207. However, other coupling peg shapes and sizes are possible. The configuration of first barbell upper mounting bracket 210 and coupling mechanisms are different in other embodiments not depicted.

Figure 10A:
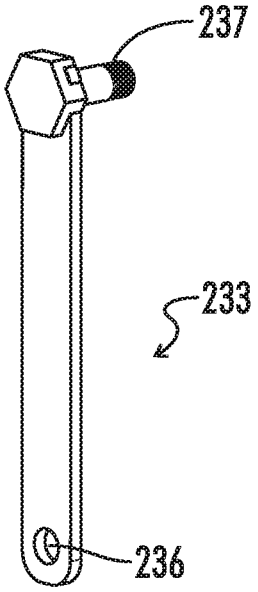
FIG. 10A-C are perspective views of support components for the first barbell support system of FIG. 6.
Figure 10B:
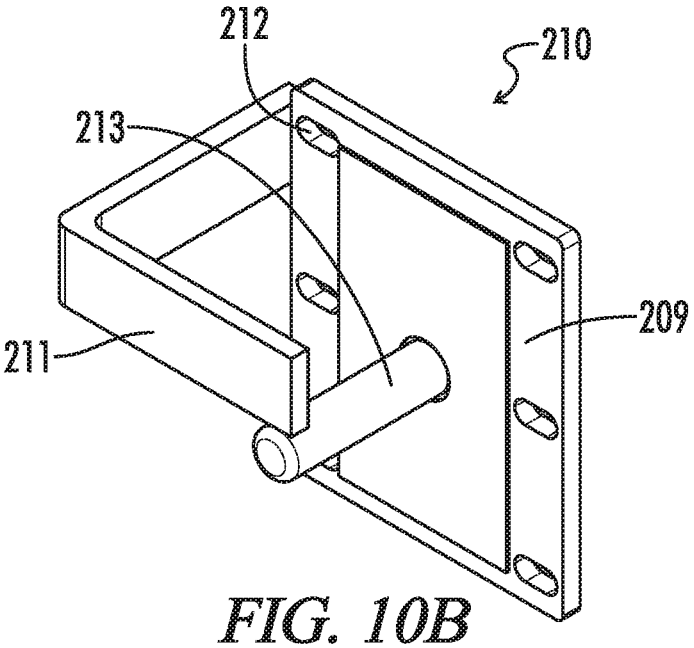
Figure 10C:
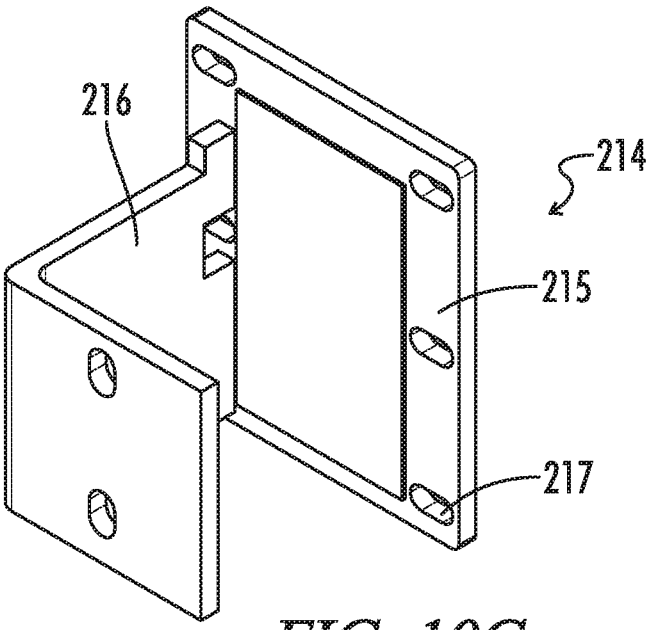

First barbell lower mounting bracket 214, as depicted by FIG. 10C, comprises a first barbell lower mounting bracket plate 215 and a first barbell lower mounting bracket flange 216, wherein first barbell lower mounting bracket flange 216 extends from one side of first barbell lower mounting bracket plate 215. First barbell lower mounting bracket plate 215 and first barbell lower mounting bracket flange 216 further include a plurality of first barbell lower mounting bracket holes 217 to provide means for coupling with other parts in system 200. First barbell lower mounting bracket plate 215, in the depicted embodiment, is of a rectangular shape and first barbell lower mounting bracket flange 216 is 'L-shaped'. First barbell lower mounting bracket plate 215 is configured to rest against one side of first barbell vertical elements 203, 205 and first barbell lower mounting bracket flange 216 is positioned around first barbell vertical elements 203, 205 to rest against the opposite side of first barbell vertical support elements 203, 205. The dimensions of first barbell lower mounting bracket 214 are chosen so that first barbell lower mounting bracket 214 encloses first barbell vertical elements 203, 205 and provides a mounting function for first barbell arm assembly 208. In the depicted embodiment in FIG. 9, first barbell lower mounting bracket 214 is configured to be coupled with first barbell vertical element 203, 205 by the use of threaded bolts via the plurality of first barbell lower mounting bracket holes 217. First barbell lower mounting bracket 214, in other embodiments, includes other configurations and coupling mechanisms.

First barbell resting plate 218, as depicted by FIG. 9, is configured to be coupled with first barbell mounting brackets 210, 214 and includes one or more first barbell resting plate holes 219. First barbell upper mounting bracket 210 is coupled to first barbell resting plate 218 on an upper side of first barbell resting plate 218 using first barbell resting plate holes 219 near its upper side, and first barbell lower mounting bracket 214 is coupled to first barbell resting plate 218 on a lower side of first barbell resting plate 218 using first barbell resting plate holes 219 near its lower side. The coupling of first barbell upper mounting bracket 210 and first barbell lower mounting bracket 214 with first barbell resting plate 218, in the depicted embodiment, is realized by one or more threaded bolts, although in other embodiments other configurations of first barbell resting plate 218 and other coupling mechanisms are possible.

First barbell resting plate 218 further includes a first barbell resting plate clamping provision 220 for first barbell elbow plates 222, 223. First barbell resting plate clamping provision 220, in the depicted embodiment, extend from first barbell resting plate 218 proximate at the top end of first barbell resting plate 218, wherein first barbell elbow plate 222 is configured to be clamped and secured into first barbell resting plate clamping provision 220. First barbell resting plate clamping provision 220 includes a plurality of first barbell resting plate clamping provision holes 221 to facilitate the coupling of first barbell elbow plate 222 with first barbell resting plate 218.

First barbell holder 224, as depicted by FIG. 9, is configured to support first barbell arm 226 and assist in the pivoting of first barbell arm 226. First barbell holder 224 is coupled proximate at the bottom side of first barbell resting plate 218 and includes one or more first barbell holder holes 225 to facilitate coupling with first barbell arm 226. In the depicted embodiment, first barbell holder 224 is a u-section channel and is welded to first barbell resting plate 218, such that the u-section of first barbell holder 224 is facing upwards. Also, the cross-section of first barbell holder 224 is equal to or larger than the cross-section of first barbell arm 226. In other embodiments, other configurations and shapes of first barbell holders 224 and coupling mechanisms are possible.

A holder shaft 227 is inserted in first barbell holder 224 through holes of first barbell holder 224 proximate at the top end of first barbell holder 224, as depicted by FIG. 9. Holder shaft 227 is configured to facilitate attachment for extension spring 232. The length of holder shaft 227 is chosen such that it connects opposite ends of first barbell holder 224. Holder shaft 227 is coupled to first barbell holder 224 by one or more threaded screws. In one embodiment, holder shaft 227 forms an integral part of first barbell holder 224 and is made with first barbell holder 224 as a single unit. In some embodiments, holder shaft 227 is welded with first barbell holder 224. In other embodiments, other shapes and sizes of holder shafts 227 with other coupling mechanisms are possible.

First barbell arm 226, as depicted by FIG. 9, is configured to enable the pivoting function of first barbell arm assemblies 208, wherein first barbell arm 226 is configured to toggle between first barbell extension position 228 and first barbell retracted position 229. First barbell arm 226 pivots about the pivot axis B-B, where first barbell arm 226 is connected with first barbell holder 224. First barbell arm 226 has a plurality of first barbell arm holes 230 on its surface for coupling purposes and first barbell arm 226, and includes first barbell arm cradle 231 at the top portion of first barbell arm 226. First barbell arm cradle 231 is configured to hold barbell 201. First barbell arm 226 and first barbell arm cradle 231 are u-shaped channels, wherein the u-section of first barbell arm 226 faces first barbell resting plate 218 and the u-section of first barbell arm cradle 231 faces upwards to receive barbell 201. Further, in the depicted embodiment, first barbell arm cradle 231 has a raised lip angled outward from first barbell arm cradle 231. However, in other embodiments, other shapes, sizes, and configurations of first barbell arms 226 and first barbell arm cradles 231 are possible.

As depicted by FIG. 8A and FIG. 9, one or more first barbell elbow plates 222, 223, extension spring 232 and first barbell connecting plate 233 of first barbell arm assembly 208 are configured to partially constrain the pivot motion of first barbell arm 226 about first barbell holder 224. One or more first barbell elbow plates 222, 223 are connected between first barbell resting plate 218, first barbell arm 226, and first barbell connecting plate 233. First barbell elbow plates 222, 223 include one or more holes to facilitate coupling. An upper end of first barbell elbow plate 222 is hinged to first barbell resting plate clamping provision 220, and an upper end of first barbell elbow plate 223 is hinged to first barbell arm 226. The lower end of first barbell elbow plates 222, 223 are hinged together to a top end of first barbell connecting plate 233. As first barbell arm 226 pivots, on account of weight acting on system 200, first barbell elbow plate 223 deflects in the direction of first barbell arm 226, and consequently first barbell elbow plate 222 deflects in the opposite direction. The deflection of first barbell elbow plates 222, 223 reaches a position after which first barbell elbow plates 222, 223 do not deflect further, denoting a first barbell elbow plate extension position 234 (FIG. 8A, right) and prevents further pivot motion of first barbell arm 226 about pivot axis B-B. When load is removed, first barbell elbow plates 222, 223 reach a first barbell elbow plate retracted position 235, after which first barbell elbow plates 222, 223 are as close to vertically oriented as possible (FIG. 8A, left). This position prevents further pivot motion of first barbell arm 226 about pivot axis B-B toward first barbell support frame 202. In the depicted embodiment, first barbell elbow plates 222, 223 are connected to first barbell resting plate 218, first barbell arm 226, and first barbell connecting plate 233 through one or more threaded bolts and nuts. In some embodiments, first barbell elbow plates 222, 223 are integrally constructed with first barbell arm assembly 208. In some embodiments, first barbell elbow plates 222, 223 are permanently or semi-permanently coupled. In other embodiments, other configurations of first barbell elbow plates 222, 223 with other coupling mechanisms are possible.

First barbell connecting plate 233 of first barbell arm assembly 208, as depicted by FIG. 8A and FIG. 10A, is configured to connect extension spring 232 with first barbell elbow plates 222, 223 and transfer the weight acting on system 200 to extension spring 232. First barbell connecting plate 233 includes one or more first barbell connecting plate holes 236 for coupling purposes, wherein the top end of first barbell connecting plate 233 is connected to first barbell elbow plates 222, 223, as described above and at the bottom end of first barbell connecting plate 233 is connected to extension spring 232. As first barbell elbow plates 222, 223 deflect, first barbell connecting plate 233 undergoes a linear motion with respect to its connection points. In the depicted embodiment, first barbell connecting plate 233 is a rectangular plate, although in other embodiments other shapes and sizes of first barbell connecting plate 233 are possible. Moreover, in the depicted embodiment, first barbell connecting plate 233 includes a first barbell connecting plate threaded fastener 237 on the top end of first barbell connecting plate 233, to be coupled with first barbell elbow plates 222, 223, and first barbell connecting plate 233 is connected to extension spring 232 by threaded bolts and nuts. In some embodiments, first barbell connecting plate 233 is integrally constructed with first barbell arm assembly 208. In other embodiments, other configurations, shapes, and sizes of first barbell connecting plate 233 and other coupling mechanisms are possible.

Extension spring 232, depicted by FIG. 8A and FIG. 9, is configured to oppose extension of system 200 and is configured to bring first barbell arm assembly 208 to first barbell retracted position 229. Extension spring 232 includes a plurality of extension spring coils 238, an upper extension spring hook 239, and a lower extension spring hook 240. The plurality of extension spring coils 238 is configured to perform elongation and contraction function of extension spring 232, whereas upper extension spring hook 239 and lower extension spring hook 240 are configured to facilitate attachment of other parts with extension spring 232 and transfer the weight to extension spring coils 238. Extension spring coils 238 are wound tightly to each other with initial tension. Upper extension spring hook 239 is coupled to first barbell connecting plate 233, as described above and lower extension spring hook 240 is connected to holder shaft 227 by inserting lower extension spring hook 240 around holder shaft 227. In an exemplary embodiment, as the weight is acting on the system, the load is transferred to extension spring coils 238 and extension spring 232 elongates when the initial tension of extension spring 232 is overcome by the weight acting on extension spring 232, enabling first barbell arm 226 to pivot to first barbell extended position 228. First barbell arm 226 stays in first barbell extended position 228 until barbell 201 is removed from system 200. Once the weight is removed, extension spring 232 returns to the original position of extension spring 232, and thereby first barbell arm 226 retracts to first barbell retracted position 229. The parameters of extension spring 232 are chosen, such that extension spring 232 is able to bear the load of system 200.

Figure 7A:
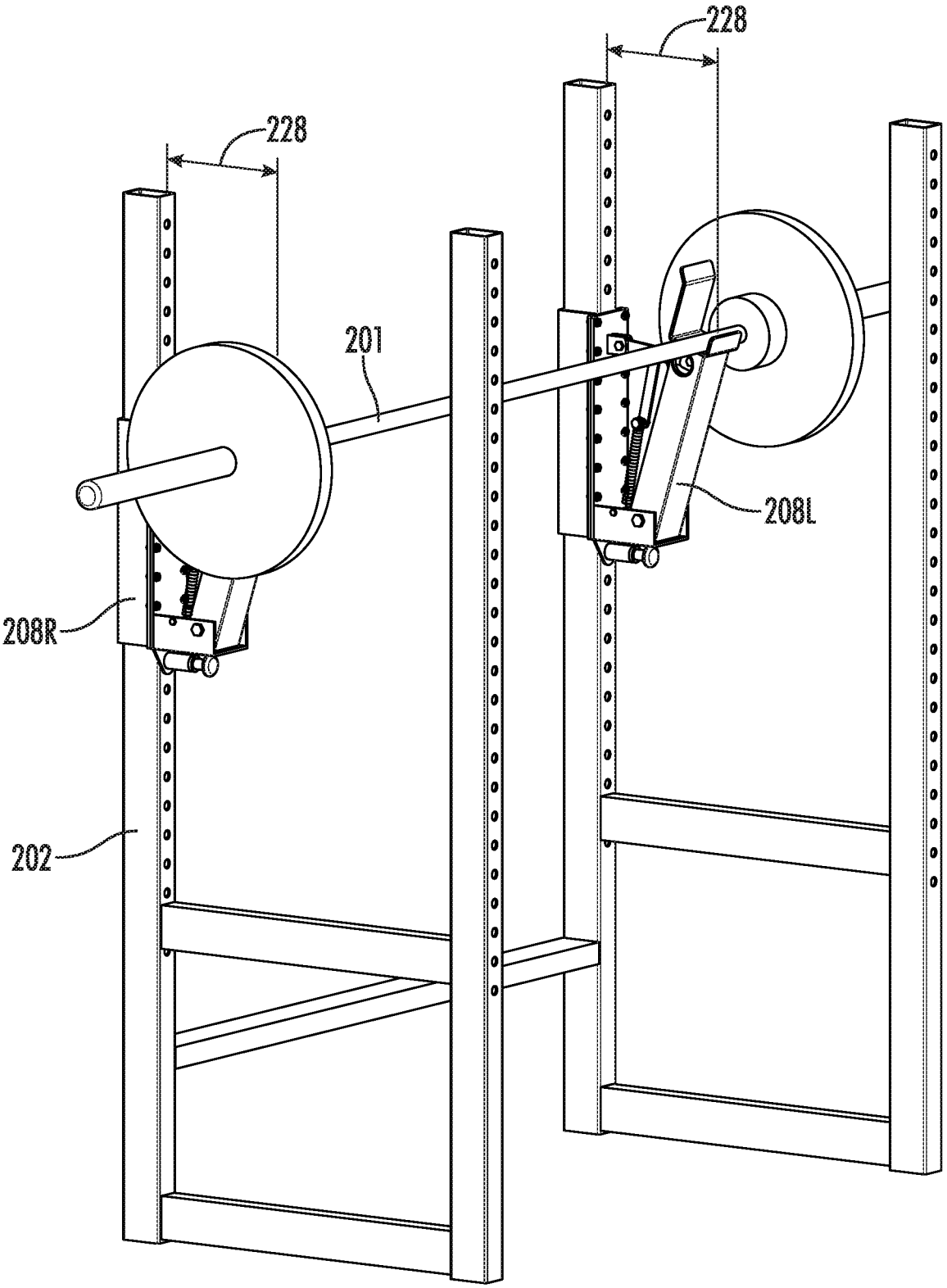
FIG. 7A-B are perspective views of the first barbell support system of FIG. 6.
Figure 7B:
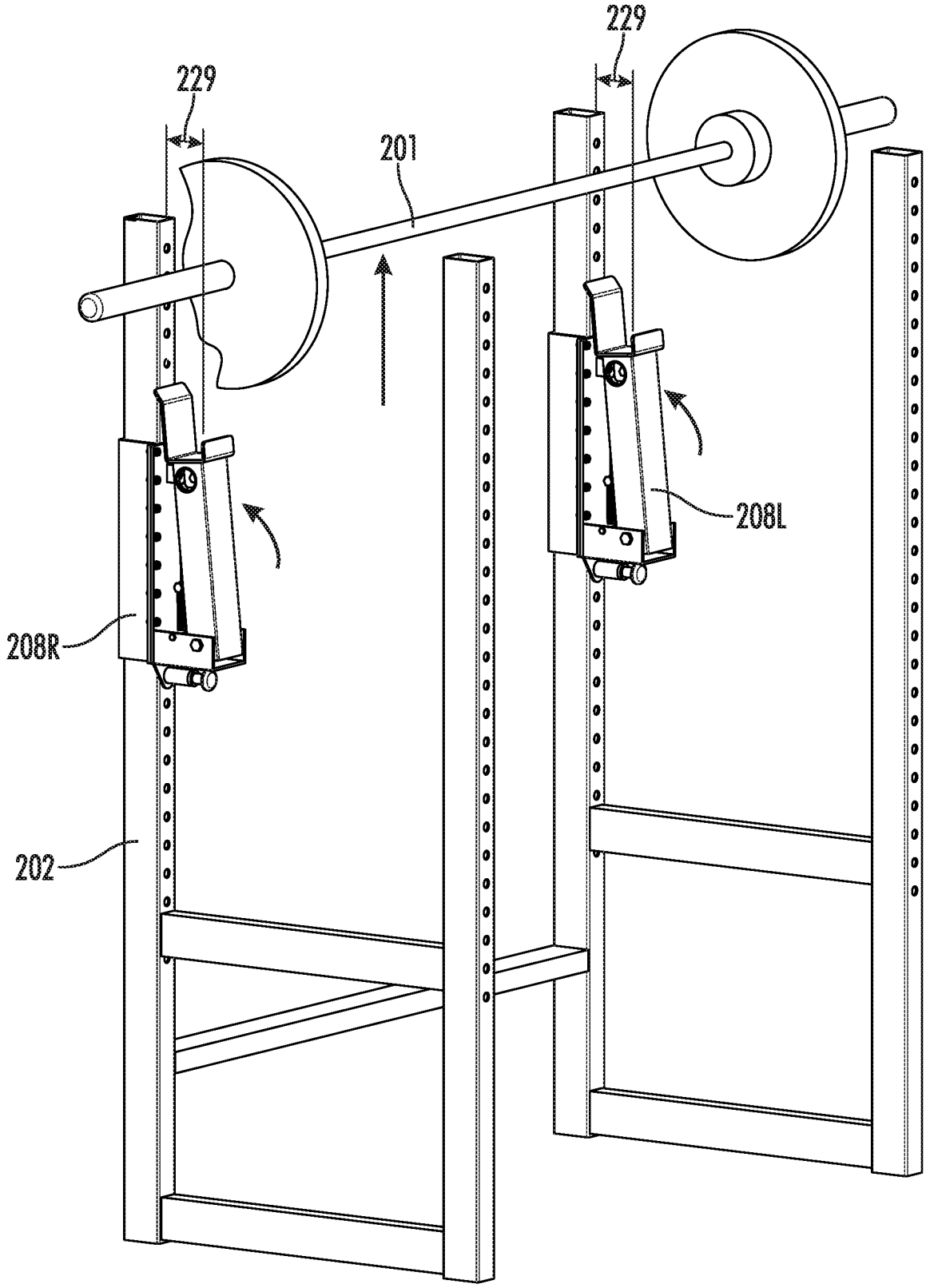

Now referring to FIG. 7A-B, prospective views of first barbell extended position 228 and retracted position 229 of system 200 are depicted. In the depicted embodiment, first barbell assemblies 208R, 208L are extended along with barbell 201 on first barbell arm cradles 231, wherein when barbell 201 is placed in system 200 in first barbell retracted position 229, first barbell assemblies 208 are extended by the user, away from first barbell support frame 202. As first barbell assemblies 208 are extended, first barbell arms 226 pivot about pivot axis B-B, and consequently first barbell elbow plates 222, 223 start deflecting, with first barbell connecting plate 233 translating upwards and transferring the load to extension spring 232, thereby elongating extension spring 232. When first barbell elbow plates 222, 223 reach first barbell elbow plate extended position 234, extension spring 232 cannot elongate further, and thereby the pivot motion of first barbell arm 226 stops. Consequently, further extension of first barbell arm assemblies 208 is not possible, indicating first barbell extension position 228. Further, in the depicted embodiment, the elongation of extension spring 232 stops when the load acting on extension spring 232 is not sufficient to create further elongation in extension spring 232 or when first barbell elbow plates 222, 223 reach first barbell elbow plate extended position 234.

When the user grabs and lifts barbell 201 from system 200, the tension force required to overcome the initial tension of extension spring 232 is absent, retracting extension spring 232 to its original position. Hence, first barbell connecting plate 233 translates downwards, first barbell elbow plates 222, 223 trace the deflection path back, and first barbell arm 226 pivots back to first barbell retracted position 229.

Figure 11:
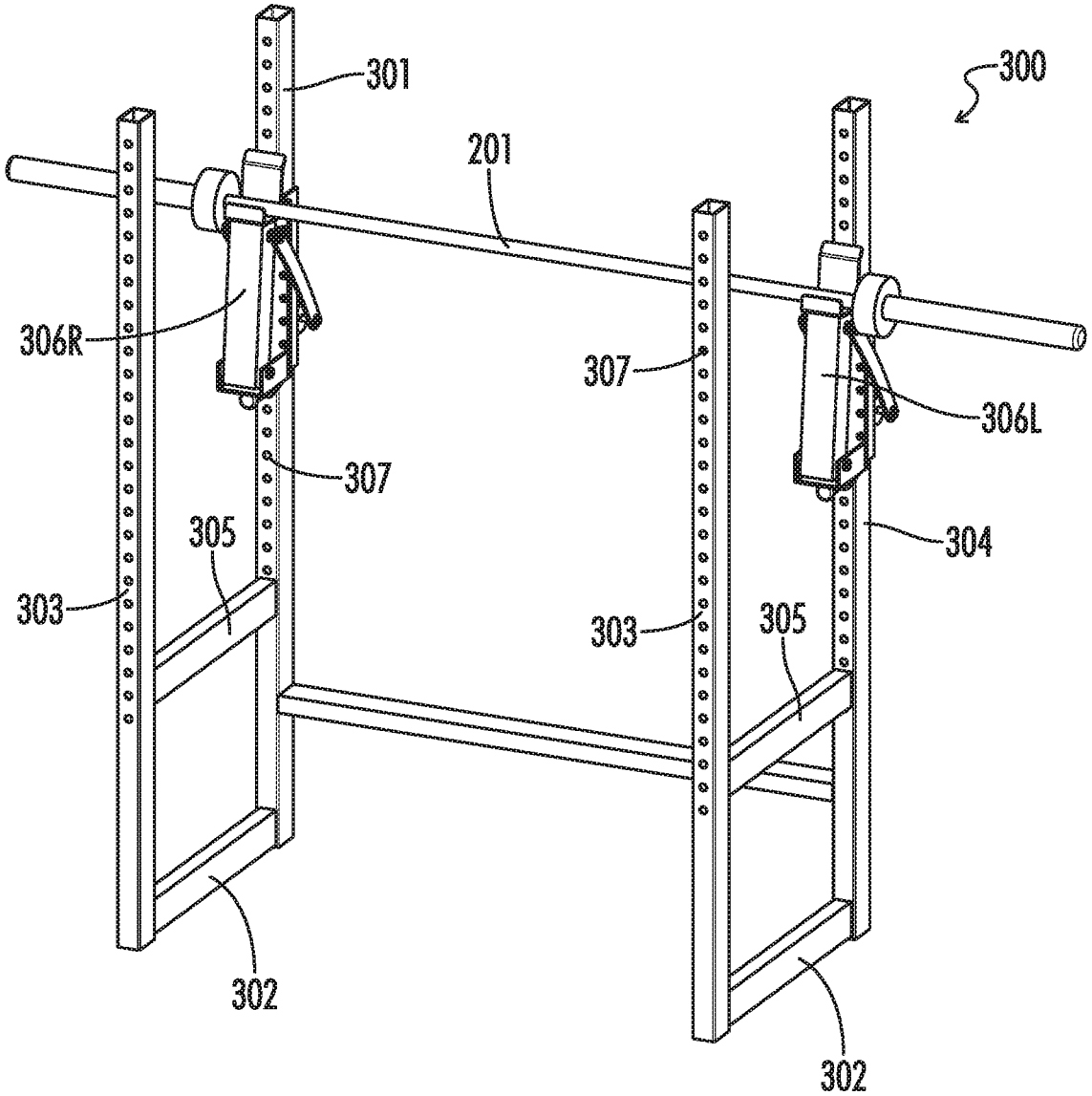
FIG. 11 is a perspective view of a third embodiment of a support system, displaying a second barbell support system.

Referring now to FIG. 11, there is presented a third embodiment of the present invention with second barbell support system 300. In an exemplary embodiment of the invention, system 300 comprises a pair of extendable second barbell arm assemblies 306R, 306L attached to second barbell support frames 301. Second barbell arm assemblies 306R, 306L are identical in most cases. System 300 is intended to be an improvement to or an attachment to preexisting weight bench presses of all types, as well as weight lifting racks of all types and weight machines of all types, but not to exclude any devices that could be made in the future. Second barbell arm assemblies 306 comprise second barbell arm cradles 320, to hold barbell 201. In such an embodiment, barbell 201 is placed on second barbell arm assemblies 306, which are extended to a distance away from second barbell support frame 301 (referred to as the second barbell extension position 321). Barbell 201 is supported by system 300 at second barbell extension position 321. Furthermore, when barbell 201 is removed from system 300 at second barbell extension position 321, second barbell arm assemblies 306 retract back to second barbell support frame 301 (referred to as the second barbell retracted position 322). Barbell 201 is supported at second barbell retracted position 322.

For example, when a user, at an accessible distance from system 300, performs exercises, the user places barbell 201 in second barbell arm cradles 320, while second barbell arm assemblies 306 are at second barbell retracted position 322. The user extends second barbell assemblies 306 to second barbell extension position 321 to deliver barbell 201. When the user begins the exercise, barbell 201 is unloaded from second barbell arm assemblies 306, and automatic retraction of second barbell arm assemblies 306 clears the line of action of exercise. Therefore, system 300 enables the user to perform the exercise without having to move away from system 300 or seek the help of others to grab and lift barbell 201. The retraction of second barbell arm assemblies 306 is a distance such that the user is capable of replacing barbell 201 back onto second barbell arm cradle 320 without the help of others.

FIG. 11 depicts second barbell support system 300. System 300 for supporting barbell 201 comprises second barbell support frame 301 and extendable second barbell arm assemblies 306. Second barbell support frame 301 is configured to provide a supporting function for system 300 and second barbell arm assemblies 306 are configured to move to second barbell extension position 321 (FIG. 14A) or second barbell retracted position 322 (FIG. 14B), as is described in detail later.

Second barbell support frame 301 comprises a second barbell support base 302, one or more second barbell front vertical elements 303, one or more second barbell rear vertical elements 304 and one or more second barbell support plates 305. Second barbell front vertical elements 303 and second barbell rear vertical elements 304 are parallel to each other and separated by a longitudinal distance. Second barbell front vertical elements 303 are parallel to each other and separated by a distance in a lateral direction. Second barbell front vertical elements 303 and second barbell rear vertical elements 304 rest on second barbell support base 302, which rests on the floor or ground. Second barbell support plates 305 connect second barbell front vertical elements 303 with second barbell rear vertical elements 304, and connect second barbell rear vertical elements 304 with second barbell support base 302 on a rear side of second barbell rear vertical elements 304, as shown by FIG. 11. Second barbell support plates 205, connecting second barbell front 303 and rear vertical frames 304, are displaced at a perpendicular distance vertically. Second barbell front 303 and rear vertical elements 304 and second barbell support plates 305 include a plurality of second barbell support frame holes 307 to facilitate coupling.

Second barbell support base 302, second barbell front 303 and rear vertical elements 304 and second barbell support plates 305 are hollow tubes with a rectangular cross section. Second barbell front 303 and the rear vertical elements 304 are welded to second barbell support base 302, second barbell support plates 205 are attached to second barbell vertical elements 303, 304 by welding, and second barbell support plates 305 connect second barbell rear vertical elements 304 with second barbell support base 302 through welding. In some embodiments, second barbell support base 302, second barbell front 303 and rear vertical elements 304, and second barbell support plates 305 are a solid tube. In some embodiments, second barbell support frame 301 includes multiple second barbell vertical elements 303, 304 resting on second barbell support base 302. In some embodiments, second barbell support frame 301 is constructed as a single unit. However, in other embodiments, other configurations of second barbell support frame 301 and other coupling mechanisms are possible.

Figure 12A:
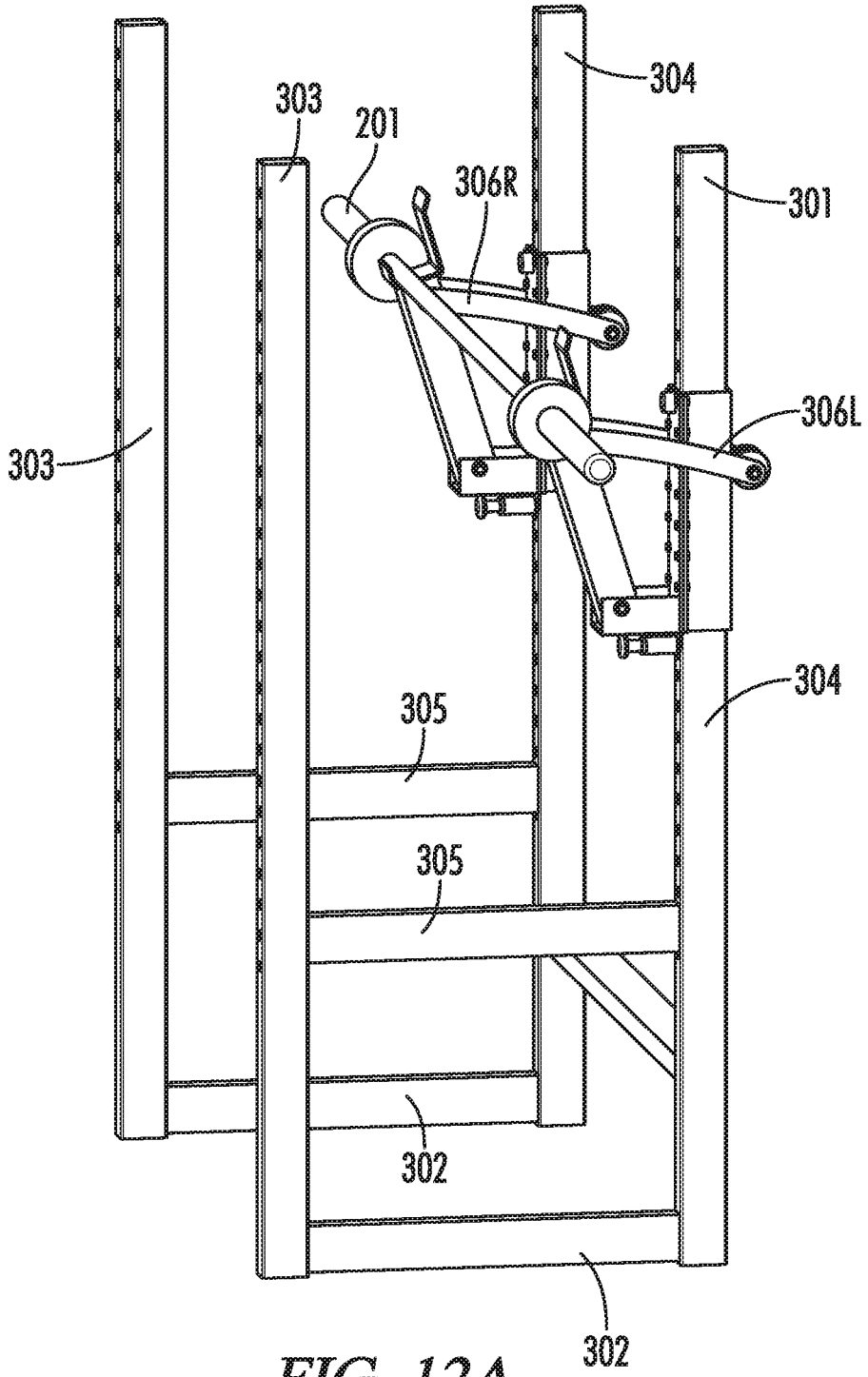
FIG. 12A-C are views of the second barbell support system of FIG. 11.
Figure 12B:
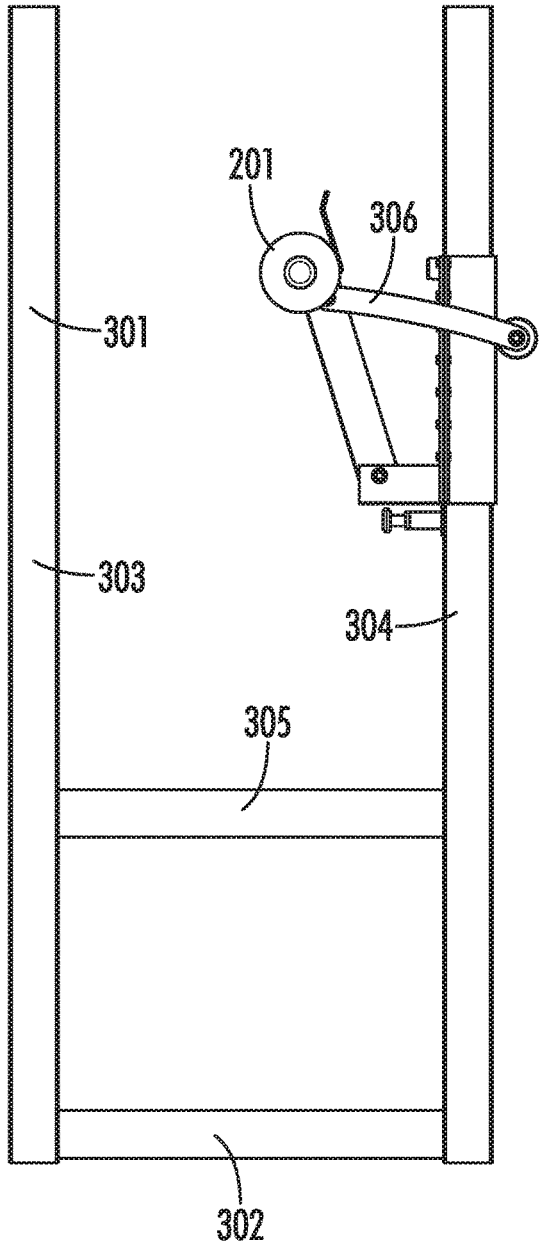
Figure 12C:
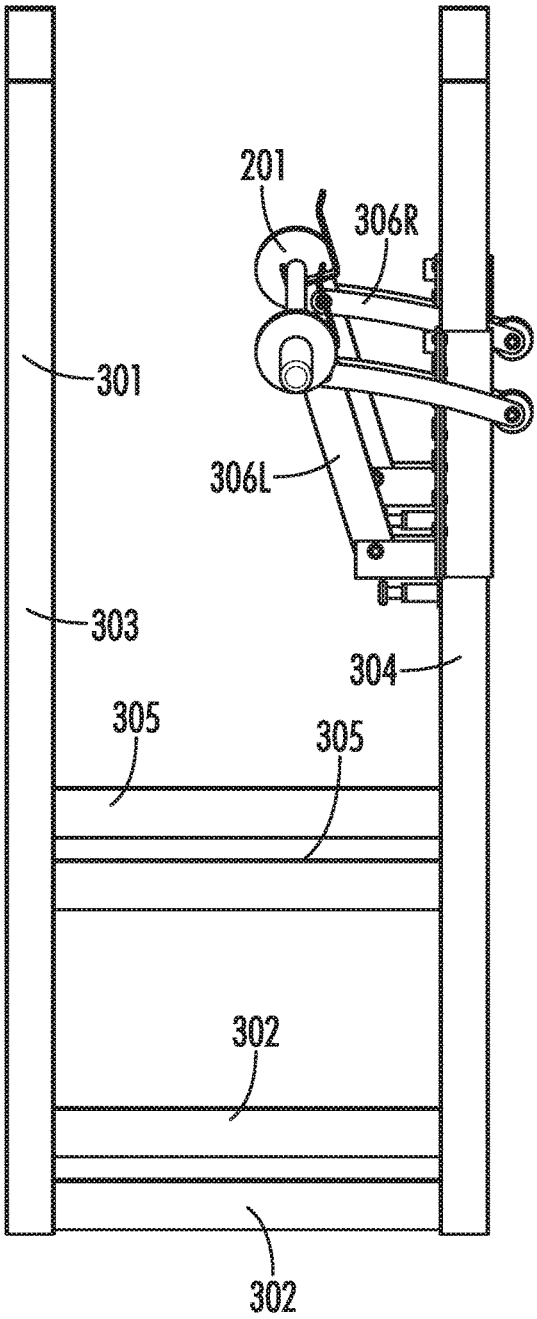
Figure 13:
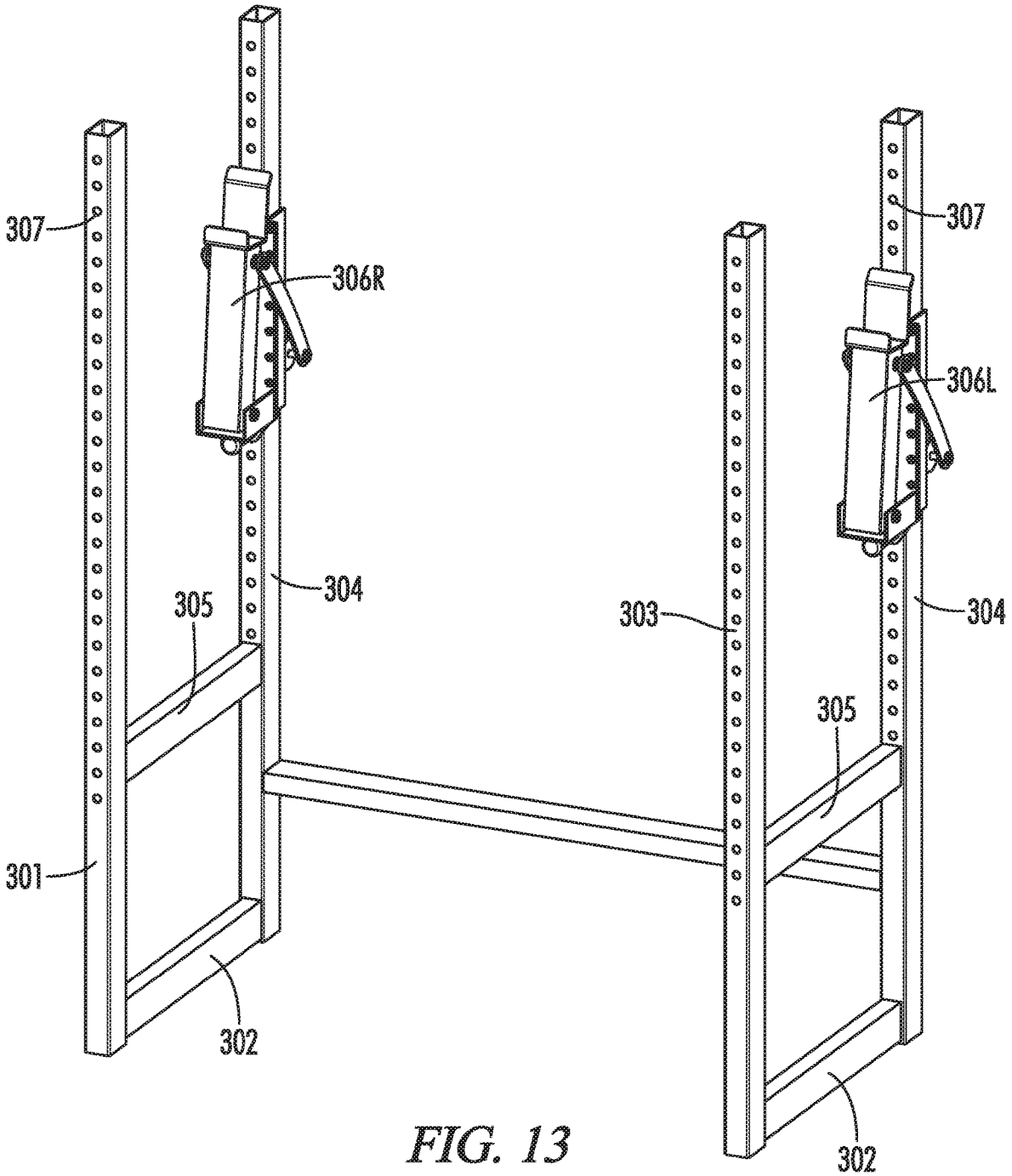
FIG. 13 is a perspective view of second barbell arm assemblies of the second barbell support system of FIG. 11 in a retracted position on a support frame.
Figure 14A:
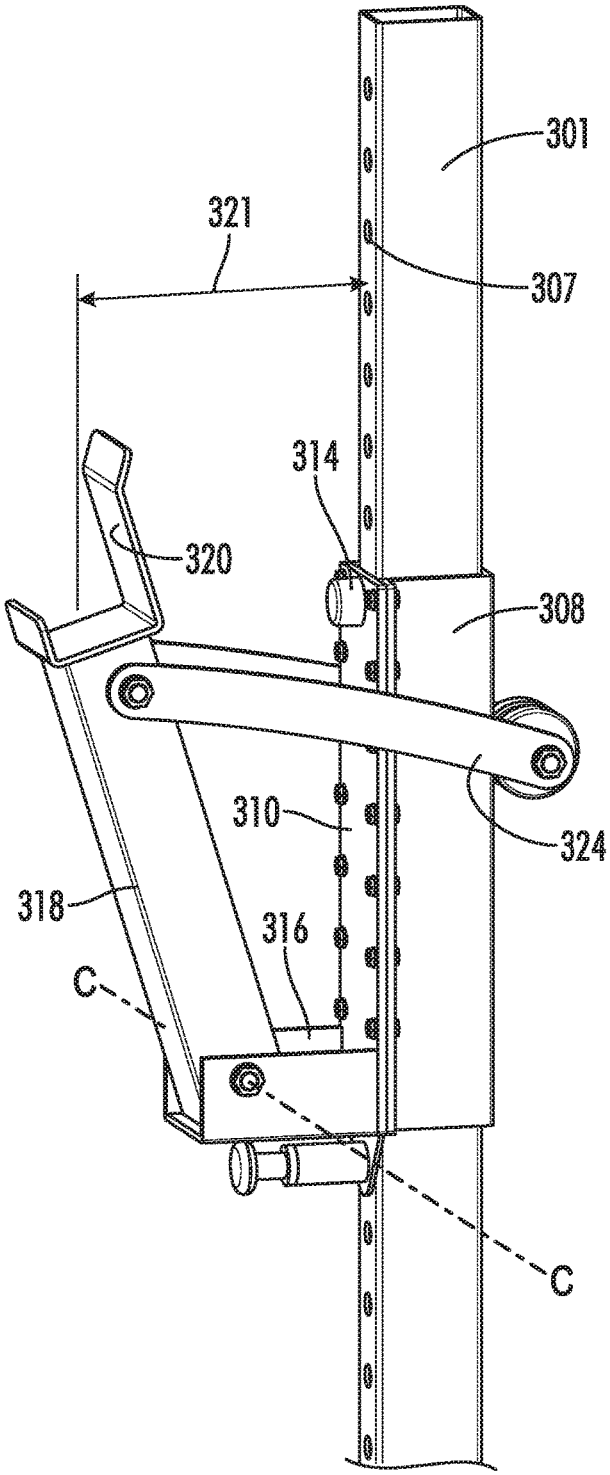
FIG. 14A-B are perspective views of the second barbell arm assemblies of the second barbell support system of FIG. 11 on a support frame in close detail.
Figure 14B:
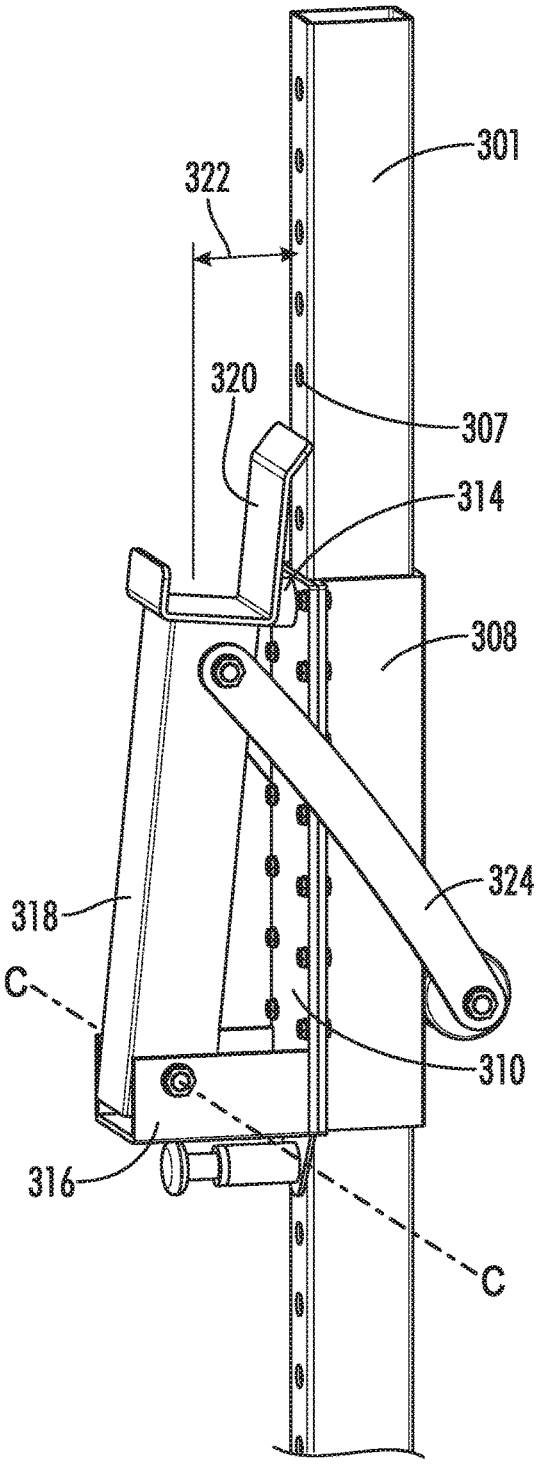

FIG. 14A-B depict second barbell arm assembly 306, which comprises a second barbell mounting element 308, a second barbell holder 316, a second barbell resting plate 310 and a second barbell arm 318. Second barbell arm assembly 306 is configured to toggle to second barbell extension position 321 (FIG. 14A) and second barbell retracted position 322 (FIG. 14B). Second barbell extension position 321 denotes a position where second barbell arm 318 is pivoted to a maximum allowable distance away from second barbell support frame 301 about the pivot axis C-C. Second barbell retracted position 322 denotes a position where second barbell arm 318 is pivoted about the axis C-C, towards second barbell support frame 301, and rests on second barbell support frame 301. Second barbell arm assembly 318 is installed onto second barbell frame 301 on second barbell front 303 or rear vertical elements 304. In the depicted embodiment in FIG. 12A, one second barbell arm assembly 306 is installed each on second barbell rear vertical elements 304. Further, the position of second barbell assembly 306 on second barbell vertical elements 303, 304 is variable as required by the user. For example, in FIG. 12B, a side view shows the height of second barbell assembly 306 on second barbell support frame 301, while FIG. 12C shows a perspective view of the same. The height of second barbell assemblies 306 is changed by attaching second barbell assemblies 306 to second barbell support frame 301 using different second barbell support frame holes 307. Similarly, FIG. 13 shows second barbell assemblies 306 in second barbell retracted position 322 at a desired height on second barbell support frame 301. In some embodiments, second barbell arm assembly 306 are integrated with second barbell support frame 301 and are constructed as a single unit. In some embodiments, second barbell assembly 306 is permanently fixed at a position. However, in other embodiments, other configurations of second barbell arm assembly 306 are possible.

Figure 15A:
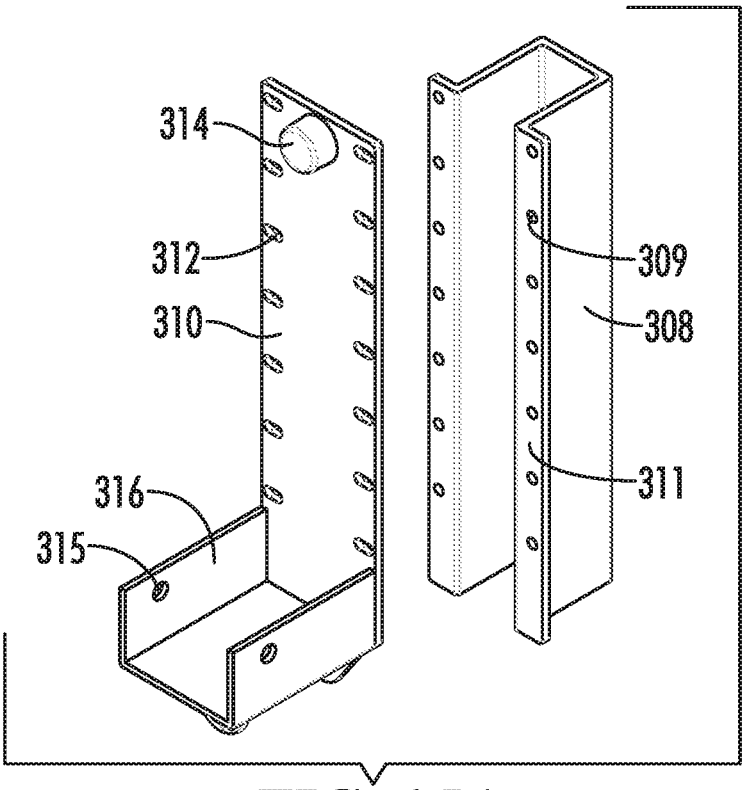
FIG. 15A-D are perspective views of support components for the second barbell support system of FIG. 11.
Figure 15B:
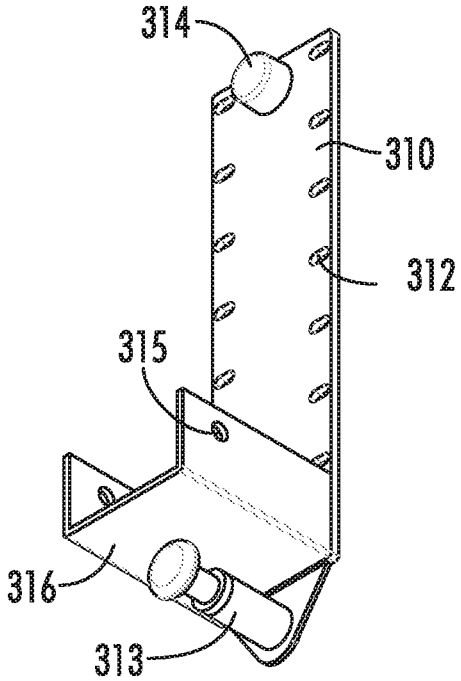
Figure 15C:
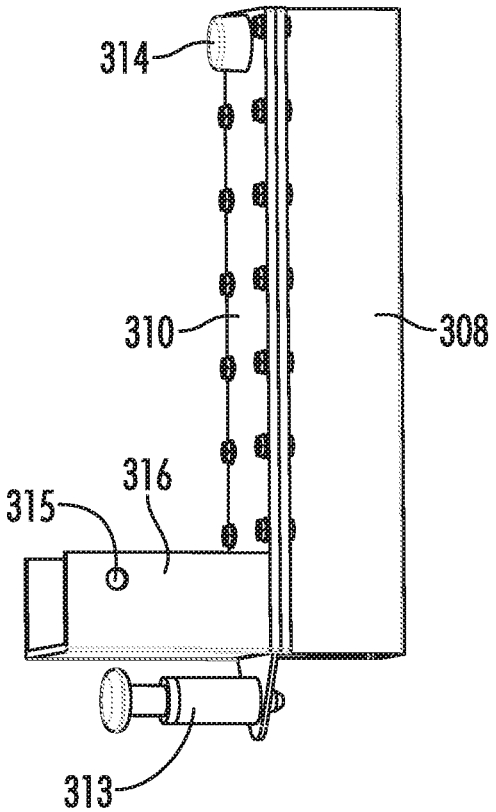

Second barbell mounting element 308, as shown in FIG. 14A-B, FIG. 15A and FIG. 15C, is configured to assist mounting of second barbell arm assembly 306 to second barbell frame 301. As shown in FIG. 15A, second barbell mounting element 308 includes plurality of second barbell mounting element holes 309 to facilitate coupling with second barbell resting plate 310 and coupling with second barbell frame 301. In the depicted embodiment, second barbell mounting element 308 is a U-shaped channel with one or more second barbell mounting element flanges 311 having a plurality of second barbell mounting element holes 309 to enable coupling with second barbell resting plate 310, and is coupled using one or more threaded bolts, as shown in FIG. 15C. Further, the attachment of second barbell mounting element 308 with second barbell frame 301 is ensured by using a screw clamp through holes on a web of second barbell mounting element 308. The cross-section of second barbell mounting element 308 is equal to or larger than the cross-section of second barbell front 303 and rear vertical elements 304, so that second barbell arm assembly 306 is configured to be installed onto second barbell frame 301. In some embodiments, second barbell mounting element 308 is integrated with second barbell frame 301. In some embodiments, second barbell mounting element 308 is a hollow bar of rectangular cross-section. However, in other embodiments, second barbell mounting element 308 has different shapes and cross sections than those depicted, with other coupling mechanisms.

Second barbell resting plate 310, as shown in FIGS. 14A-B and FIGS. 15A-C, is configured to be coupled with second barbell mounting element 308, such that second barbell resting plate 310 rests on second barbell mounting element flanges 311. A shown in FIG. 15A, second barbell resting plate 310 includes a plurality of second barbell resting plate slots 312 to couple with second barbell mounting element 308, and a locking provision 313 to facilitate locking of second barbell arm assembly 306 onto second barbell frame 301. Locking provision 313 is a protruding cavity to accommodate a locking element, as shown in FIG. 15B. In the depicted embodiment, second barbell resting plate 310 is a plate with a rectangular cross-section, and second barbell resting plate 310 is coupled with second barbell mounting element 308 using one or more threaded bolts, as shown in FIG. 14C. In some embodiments, second barbell resting plate 310 includes other shapes and cross sections, such as a bar with a square cross-section, and is coupled with second barbell mounting element 308 by welding. In some embodiments, second barbell resting plate 310 is integrated with second barbell frame 301 as a single unit. In other embodiments, other shapes, sizes, and configurations of second barbell resting plate 310 with other coupling mechanisms are possible.

Indexing plunger is used as the locking element in one instance, as depicted by FIG. 15B. Further, as second barbell arm assemblies 306 are mounted onto second barbell frame 301, the indexing plunger locks second barbell arm assemblies 306 into second barbell support frame holes 307 of second barbell vertical support element 303, 304 for the purposes of height adjustments per the requirements of the user or as needed based on the intended exercises. Furthermore, second barbell assemblies 306 are unlocked by pulling the indexing plunger out of second barbell support frame hole 307. Alternatively, in some embodiments, locking provision 313 and the locking element are not present. In some embodiments, more than one locking provision 313 and locking element are present. In some embodiments, a screw clamp is used as the locking element. However, in other embodiments, other configurations for locking second barbell assembly 306 and other types of locking elements are possible.

Further, as shown in FIG. 15A-C, second barbell resting plate 310 includes one or more second barbell stoppage elements 314, configured to stop the pivot motion of second barbell arm 318 towards second barbell support frame 301. Second barbell stoppage elements 314 are configured to reduce vibration in second barbell assembly 306. A rubber bush is used as second barbell stoppage element 314 and is coupled to second barbell resting plate 310 using one or more threaded screws inserted into second barbell resting plate slots 312 and the holes of second barbell stoppage elements 314.

In an exemplary embodiment, as depicted by FIG. 13, the position of second barbell arm assembly 306 with respect to second barbell vertical elements 303, 304, is changed per requirements of the user by unlocking the plunger from one of second barbell support frame holes 307 in second barbell vertical elements 303, 304, unscrewing the screw clamp available on second barbell mounting element 308, inserting it into another second barbell support frame hole 307 of second barbell vertical elements 303, 304 to lock the plunger, and tightening the screw clamp. Further, second barbell arm assembly 306 is capable of being temporarily or permanently removed from second barbell frame 301 by unlocking the plunger and unscrewing the screw clamp. However, in other embodiments, other configurations of installation or removal of second barbell assembly 306 are possible.

Second barbell holder 316, as depicted by FIGS. 14A-B and FIG. 15A-C, is configured to support second barbell arm 318 and assist the pivoting of second barbell arm 318. As shown in FIG. 14A, second barbell holder 316 is coupled proximate at the bottom side of second barbell resting plate 310 and includes one or more second barbell holder holes 315 to facilitate coupling with second barbell arm 318, as shown in FIG. 15C. In the depicted embodiment in FIG. 15B, second barbell holder 316 is a U-section channel and is welded to second barbell resting plate 310, such that the U-section of second barbell holder 316 is facing upwards. Also, the cross-section of second barbell holder 316 is equal to or larger than the cross-section of second barbell arm 318. In other embodiments, other configurations of second barbell holders 316 and coupling mechanisms are possible.

Figure 15D:
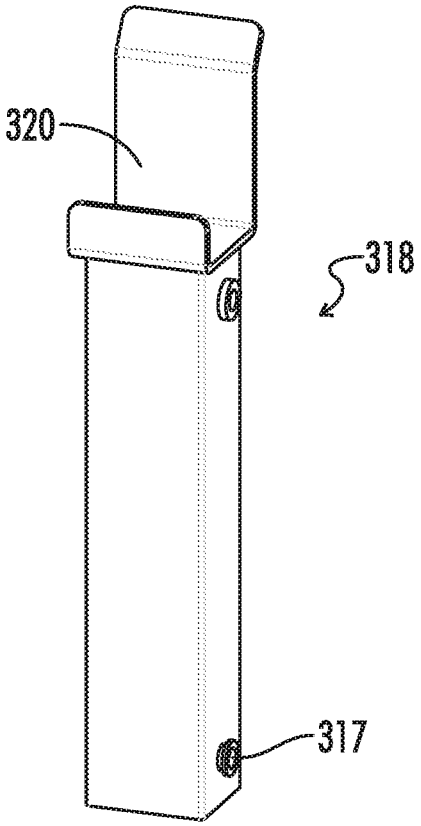

Second barbell arm 318, as shown by FIGS. 14A-B and FIG. 15D, is configured to enable the pivoting function of second barbell arm assembly 306, wherein second barbell arm 318 is configured to toggle between second barbell extension position 321 and second barbell retraction position 322. Second barbell arm 318 has a plurality of second barbell arm holes 317 on its surface and includes second barbell arm cradle 321 on the top portion of second barbell arm 318, as shown in FIG. 15D. Second barbell arm cradle 321 is configured to hold barbell 201. Second barbell arm 318 includes one or more connecting provisions to couple with a connecting rod assembly 324. Second barbell arm 318 is a hollow bar of a rectangular cross-section and second barbell arm cradle 320 is U-shaped channel configured to receive barbell 201. Further, in the depicted embodiment in FIG. 14A-B, second barbell arm cradle 320 has a raised lip angled outward from second barbell arm cradle 320. The raised lip is configured to rest on second barbell support frame 301 when second barbell assembly 306 is in second barbell retracted position 322. However, in other embodiments, other shapes, sizes, and configurations of second barbell arms 318 and second barbell arm cradles 320 are possible.

In the depicted embodiment, second barbell arm 318 is coupled to second barbell holder 316 using one or more screws, such that second barbell arm 318 pivots about the pivot axis C-C, where second barbell arm 318 and second barbell holder 316 are coupled together. Further, in the depicted embodiment, second barbell arm 318 is coupled to second barbell holder 316 through one or more threaded screws. In other embodiments, other kinds of coupling configurations and coupling mechanisms are possible.

Figure 16A:
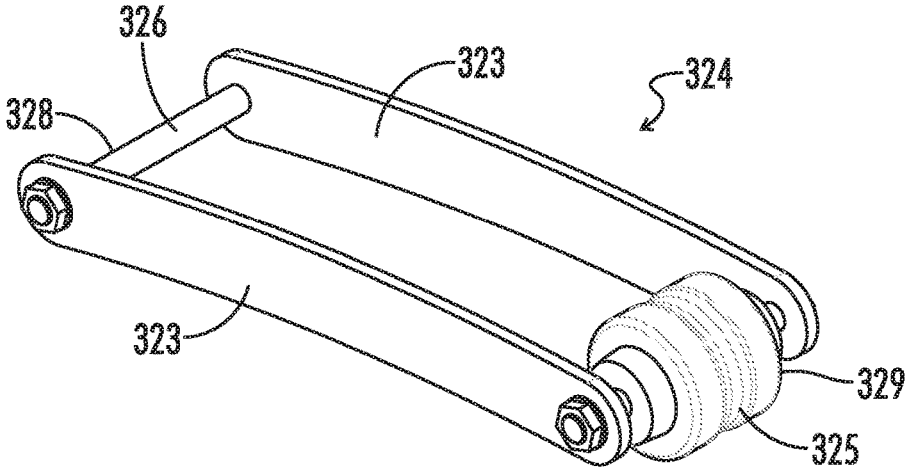
FIG. 16A-B are views of the connecting rod assembly of the second barbell support system of FIG. 11.
Figure 16B:
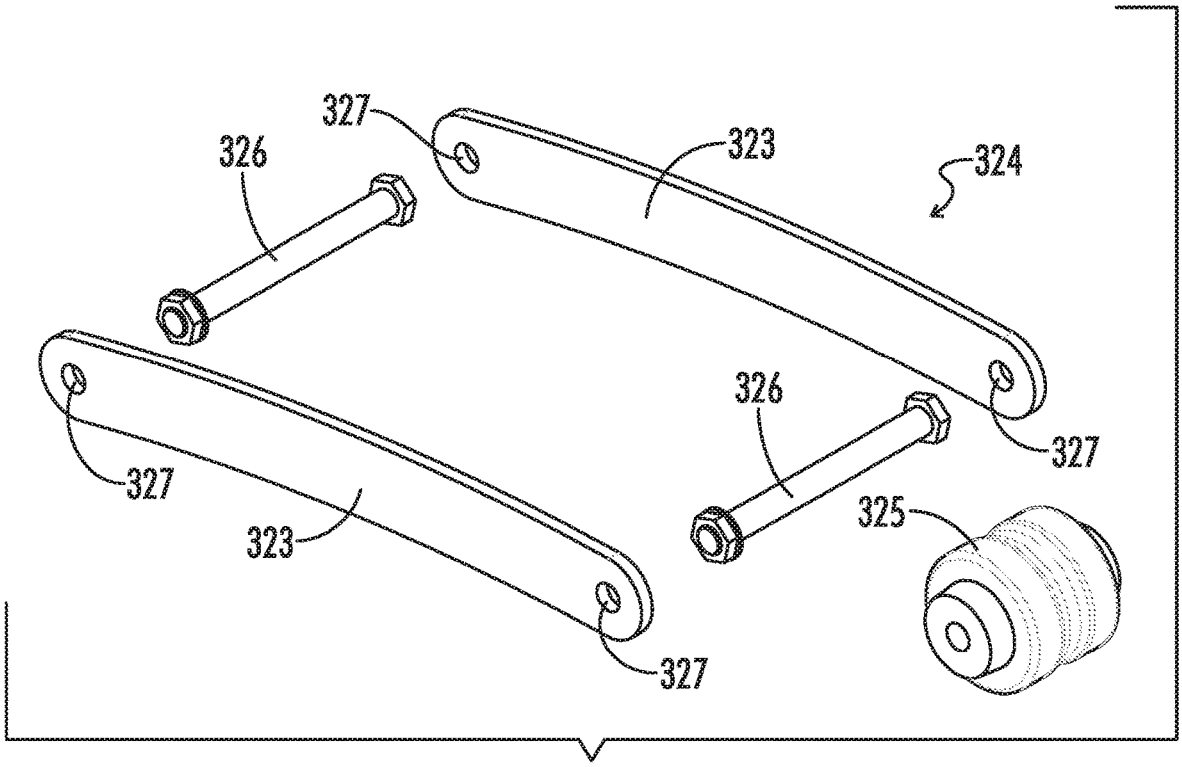

Connecting rod assembly 324, as depicted by FIGS. 14A-B and FIG. 16A-B, is configured to partially constrain the pivot motion of second barbell arm 324 and facilitate the retraction mechanism of second barbell arm assembly 306. As shown in FIG. 16A, connecting rod assembly 324 comprises one or more second barbell connecting rods 323 one or more wheels 325, and one or more connecting rod linking elements 326. Second barbell connecting rods 323 include one or more connecting rod holes 327 to facilitate coupling, as shown in FIG. 16B. Connecting rod linking elements 326 are configured to link second barbell connecting rods 323. One end of second barbell connecting rods 323 are connected to sides of second barbell arm 318 near a top of second barbell arm 318, via the connecting provisions present in second barbell arm 318, wherein connecting rod linking elements 326 are received into the connecting provisions present in second barbell arm 318, to enable linking. The aforementioned end is denoted as a connecting rod front end 328. Another end of the second barbell connecting rods 323 are coupled by connecting rod linking elements 326 on a back of second barbell arm assembly 306, wherein wheels 325 are mounted to connecting rod linking elements 262 and wheels 325 are configured to rest against a surface of second barbell mounting element 308. The aforementioned end is denoted as a connecting rod rear end 329.

Wheels 325 have one or more holes to facilitate mounting onto connecting rod linking element 326. Depending on the dimension of wheels 325 used, one or more washers are added to connecting rod linking element 326 to prevent the sideways motion of wheel 325 on connecting rod linking element 326.

In the depicted embodiment, second barbell connecting rods 323 are a plate. Further, in the depicted embodiment, connecting rod linking elements 326 are a single separate unit and are threaded inside on both sides to receive threaded bolts that facilitate coupling of connecting rod linking element 326 and second barbell connecting rods 323. One or more threaded bolts are used for coupling purposes. In some embodiments, connecting rod linking elements 326 are integrated with one second barbell connecting rod 323 to link with another second barbell connecting rod 323. In some embodiments, connecting rod linking elements 326 are multiple units that are coupled together. In some embodiments, connecting rod assembly 324 is integrated with second barbell arm 318 as a single unit. Furthermore, in the depicted embodiment, connecting rod assembly 324 is configured such that second barbell connecting rods 323 are in an inclined position between connecting rod front end 328 and rear end 329. In other embodiments, other configurations of connecting rod assembly 324 with other coupling mechanisms and other mechanisms for constraining the motion of second barbell arm 318 are possible.

In FIG. 14A-B second barbell extension position 321 and second barbell retracted position 322 is depicted. In the depicted embodiment, second barbell arm assemblies 306 are extended along with barbell 201 on second barbell arm cradle 320, wherein, when barbell 201 is placed on system 300 at second barbell retracted position 322, second barbell arm assemblies 306 are extended by the user away from second barbell frame 301. As second barbell arm assemblies 306 are extended, second barbell arm 318 is pivoted about pivot axis C-C, connecting rod front end 328 moves pivots along with second barbell arm 318, and consequently connecting rod rear end 329 moves vertically upwards on second barbell arm assemblies 306. Second barbell arm 318 is pivoted to a maximum extendable distance, wherein connecting rod rear end 329 does not move further up on second barbell arm assembly 306 and restricts the further pivot motion of second barbell arm 318. In second barbell extension position 321, barbell 201 on second barbell arm cradle 320 balances the position of connecting rod rear end 329, such that second barbell assembly 306 stays in second barbell extension position 321 while barbell 201 is placed in system 300.

When barbell 201 is lifted from system 300, connecting rod rear end 329 moves vertically downward on second barbell arm assemblies 306, such that second barbell arms 318 coupled with connecting rod assemblies 324 retract to second barbell retracted position 322. Second barbell retracted position 322 is attained when the upper lips of second barbell arm cradles 320 are stopped by and rest on second barbell stoppage element 314, thereby halting the further pivoting motion of second barbell arms 318 towards second barbell frame 301. The holes in second barbell connecting rods 323, the length of second barbell connecting rods 323, and the location of the plurality of holes in second barbell arms 318 are designed according to the required extendable distance for second barbell extension position 321.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

It is claimed:

1. An apparatus for supporting a weight used during exercises comprising:

a base configured for being movably coupled to and extending horizontally away from a vertically extending support frame, the base having a first end adjacent to the support frame and a second end positioned away from the support frame and opposite the first end, an arm assembly including a first arm having an upper end and a lower end, the lower end being pivotally coupled to and extending vertically from the base, and a cradle coupled to the upper end of the first arm, the cradle being configured for supporting the weight, wherein the arm assembly is configured for selectively pivoting the cradle automatically between a first position defined by the first arm being positioned at an obtuse angle with respect to the base when the weight is supported by the cradle and a second position defined by the first arm being positioned at an acute angle with respect to the base when the weight is removed from the cradle.

2. The apparatus of claim 1, wherein the first position includes the cradle being at a first distance from the support frame and the second position includes the cradle being at a second distance from the support frame, the first distance being longer than the second distance.

3. The apparatus of claim 1, wherein the arm assembly includes a second arm pivotally coupled to and between the base and the cradle.

4. The apparatus of claim 3, further including a strut assembly coupled to and between the first arm and the second arm, the strut assembly being configured to move the cradle from the first position to the second position when the weight is removed from the cradle.

5. The apparatus of claim 1, wherein the cradle includes a lower cradle frame having a pair of opposed support plates, each support plate having an upturned free end.

6. The apparatus of claim 1, further including a vertically arranged sleeve to which the base is coupled, the sleeve being configured to slidably engage the support frame.

7. The apparatus of claim 6, further including a first hinge arm pivotally coupled to the sleeve, a second hinge arm pivotally coupled at one end thereof to the first arm and hingedly coupled to the first hinge arm at a second end thereof, and a spring assembly coupled to and between the base and the second end of the second hinge arm.

8. The apparatus of claim 6, further including a roller arm having a first end portion pivotally coupled to the upper end of the first arm and a second end portion supporting a wheel arranged to roll against the sleeve.

9. The apparatus of claim 1, wherein the weight is selected from the group consisting of a barbell and a dumbbell.

10. An apparatus for supporting a weight used during exercises comprising:

a base operatively coupled to and extending horizontally from a support frame, the base having a first end adjacent to the support frame and a second end positioned away from the support frame and opposite the first end, an arm assembly extending vertically from the base, the arm assembly includes a first arm being pivotally coupled to the base, a vertically arranged connection plate to which the base is coupled, the connection plate being configured for selectively attaching to the support frame, and a cradle supported by the arm assembly and configured for holding the weight, wherein the arm assembly is configured for (i) maintaining the cradle in a first position defined by the first arm being positioned at an obtuse angle with respect to the base when the weight is located on the cradle, (ii) automatically pivoting the cradle from the first position to a second position defined by the first arm being positioned at an acute angle with respect to the base when the weight is removed from the cradle, and (iii) pivoting the cradle from the second position to the first position when the weight is placed on the cradle, the first position including the cradle being at a first distance from the support frame and the second position including the cradle being at a second distance from the support frame, the first distance being longer than the second distance.

11. The apparatus of claim 10, wherein the arm assembly includes a second arm being pivotally coupled to the base.

12. The apparatus of claim 11, further including a strut assembly coupled to and between the first arm and the second arm, the strut assembly being configured for forcing the cradle to pivot from the first position to the second position.

13. The apparatus of claim 10, further including a first hinge arm pivotally coupled to the connection plate, a second hinge arm pivotally coupled at one end thereof to the arm assembly and hingedly coupled to the first hinge arm at a second end thereof, and a spring assembly coupled to and between the base and the second end of the second hinge arm.

14. The apparatus of claim 10, further including a roller arm having a first end portion pivotally coupled to the arm assembly and a second end portion supporting a rotatable member, the support frame being arranged between the rotatable member and the arm assembly.

15. An apparatus for supporting a weight used during exercises comprising:

a frame arm extending vertically, a base operatively coupled to and extending horizontally from the frame arm, a cradle for supporting the weight, a pivot arm extending vertically to and between the base and the cradle, the pivot arm being pivotally coupled to the base, wherein the cradle is pivotally coupled to the pivot arm, a first cradle position defined by the pivot arm being positioned at an obtuse angle with respect to the base, the first cradle position including the cradle being at a first distance from the frame arm, a second cradle position defined by the pivot arm being positioned at an acute angle with respect to the base, the second cradle position including the cradle being at a second distance from the frame arm, the first distance being longer than the second distance, and a first force exerted on the pivot arm sufficient to cause the cradle to pivot from the first cradle position to the second cradle position when the weight is not supported by the cradle.

16. The apparatus of claim 15, wherein the first force is exerted on the pivot arm by a strut.

17. The apparatus of claim 15, wherein the first force is exerted on the pivot arm by a spring.

18. The apparatus of claim 15, wherein the first force is exerted on the pivot arm by a downwardly-curved arm coupled to and between the pivot arm and a rotatable member wherein the frame arm is located between the pivot arm and the rotatable member.

* * * * *